US012366086B1

(12) United States Patent
Sun

(10) Patent No.: US 12,366,086 B1
(45) Date of Patent: Jul. 22, 2025

(54) FOLDABLE CANOPY

(71) Applicant: Jim Sun, Rancho Palos Verdes, CA (US)

(72) Inventor: Jim Sun, Rancho Palos Verdes, CA (US)

( * ) Notice: Subject to any disclaimer, the term of this patent is extended or adjusted under 35 U.S.C. 154(b) by 0 days.

(21) Appl. No.: 19/085,828

(22) Filed: Mar. 20, 2025

Related U.S. Application Data

(60) Provisional application No. 63/748,638, filed on Jan. 23, 2025, provisional application No. 63/644,334, filed on May 8, 2024.

(51) Int. Cl.
*E04H 15/46* (2006.01)
*E04H 15/32* (2006.01)
*E04H 15/60* (2006.01)

(52) U.S. Cl.
CPC ..... *E04H 15/46* (2013.01); *E04H 15/322* (2013.01); *E04H 15/60* (2013.01)

(58) Field of Classification Search
CPC ..... E04H 15/28; E04H 15/46; E04H 15/60; E04H 15/322
See application file for complete search history.

(56) References Cited

U.S. PATENT DOCUMENTS 2,864,389 A * 12/1958 Smith ..... E04H 15/28 135/120.2
2,937,653 A * 5/1960 Danciart ..... A45B 25/08 135/37
4,201,237 A * 5/1980 Watts ..... A45B 25/14 135/30
5,634,483 A * 6/1997 Gwin ..... E04H 15/50 135/117
5,797,411 A 8/1998 Parker
5,871,026 A * 2/1999 Lin ..... E04H 15/28 135/124
6,412,507 B1 * 7/2002 Carter ..... E04H 15/50 135/144
7,314,055 B2 * 1/2008 Guo ..... E04H 15/28 135/156
7,380,563 B2 6/2008 Seo
(Continued)

FOREIGN PATENT DOCUMENTS

CN 204238640 U 4/2015
CN 206829770 U 1/2018

*Primary Examiner* — Noah Chandler Hawk
(74) *Attorney, Agent, or Firm* — DANE IP Law PC

(57) ABSTRACT

The folding canopy provides a portable, user-friendly structure designed for single-person operation. It features telescoping support legs with three rolling feet equipped with wheels for mobility and one stationary foot with a high-friction surface to assist during deployment and folding. A cable and pulley system, operatively connected to a handle, enables deployment and retraction without requiring the user to step underneath the canopy. As the handle is pulled, the tensioned cable draws a central lower hub toward a central upper hub, causing pivoting elongate members to extend the support legs outward. Sliding feet with curved portions allow the canopy to navigate uneven terrain during deployment and folding. The telescoping legs are adjustable in height via middle brackets with locking mechanisms. Compact when folded, the canopy is easily transportable, making it ideal for outdoor events and recreational activities.

18 Claims, 40 Drawing Sheets

(56) References Cited

U.S. PATENT DOCUMENTS

| | | | | |
|---|---|---|---|---|
| 7,637,275 | B2 | 12/2009 | Stehly | |
| 9,995,056 | B2 * | 6/2018 | Yang | E04H 15/50 |
| 9,995,058 | B2 | 6/2018 | Jin | |
| 10,107,005 | B2 | 10/2018 | Song | |
| 10,273,711 | B2 | 4/2019 | Song | |
| 10,378,235 | B1 * | 8/2019 | Volin | E04H 15/46 |
| 10,669,738 | B2 | 6/2020 | Yang | |
| 10,900,251 | B2 | 1/2021 | Ferrari | |
| 10,982,465 | B2 | 4/2021 | Jin | |
| 11,434,656 | B2 | 9/2022 | Yang | |
| 2010/0282381 | A1 | 11/2010 | Badertscher | |
| 2012/0325279 | A1 | 12/2012 | Munoz | |
| 2015/0368925 | A1 * | 12/2015 | Livacich | E04H 15/44<br>135/147 |
| 2018/0023315 | A1 * | 1/2018 | Ferrari | E04H 15/32<br>135/145 |
| 2019/0150577 | A1 * | 5/2019 | Letendre | A45B 25/10 |
| 2023/0175284 | A1 | 6/2023 | Zhu | |

* cited by examiner

FOLDABLE CANOPY

CROSS REFERENCE TO RELATED APPLICATIONS

This application claims the benefit of U.S. Provisional Application No. 63/748,638, filed on 2025 Jan. 23, and U.S. Provisional Application No. 63/644,334, filed on 2024 May 8, the contents of which are expressly incorporated by reference herein.

STATEMENT RE: FEDERALLY SPONSORED RESEARCH/DEVELOPMENT

Not Applicable.

BACKGROUND

The various aspects and embodiments described herein relate to a retractable canopy.

This application is related to the Application Ser. No. 63/644,334, filed on May 8, 2024, the entire contents of which is expressly incorporated herein by reference.

Canopies are widely used for providing portable shade and shelter in various outdoor settings, such as markets, sports events, and recreational activities. Traditional canopies often require multiple individuals to set up and collapse due to their cumbersome mechanisms and the need for simultaneous adjustment of multiple structural elements. These designs can be particularly challenging to deploy or fold.

Accordingly, there is a need for an improved canopy.

BRIEF SUMMARY

The folding canopy is a portable structure designed for single-user operation, featuring a cable and pulley system connected to a pull handle at its outer periphery that enables smooth deployment and retraction without the need to step underneath. The canopy includes telescoping support legs with adjustable heights, three rolling feet equipped with wheels for mobility during deployment, and one stationary foot with a high-friction surface for stability. Curved sliding feet navigate uneven terrain, while pivoting elongate members and central hubs ensure structural alignment and stability. The canopy transitions seamlessly between folded and deployed positions, providing a versatile, durable, and user-friendly solution for outdoor shade and shelter.

A folding canopy is designed to provide shade in a deployed position and to fold compactly for storage. The canopy includes multiple telescoping support legs configured to support the structure on a surface. A central upper hub is positioned at the top of the canopy, and a central lower hub is located below it. When the canopy is in the folded position, the central upper hub and the central lower hub are separated. A plurality of elongate members are pivotably connected to one another. A first elongate member is pivotably attached to the central upper hub, and a second elongate member is pivotably attached to the central lower hub. The first and second elongate members are also pivotably connected to each other. When the central lower hub and the central upper hub are forced closer together, the elongate members pivot outward, pushing the support legs outward. Other elongate members are arranged in pairs and are pivotably connected to one another by stabilizing brackets. The pairs are connected to the support legs to stabilize the canopy in the deployed position. A handle is positioned near one of the support legs and is operatively connected to a cable. The cable is routed to and through the central upper hub and is attached to the central lower hub. A series of pulleys guide the cable through the system. Pulling the handle causes the cable to exert force on the central lower hub, moving it closer to the central upper hub. This movement causes the elongate members to push the support legs outward, transitioning the canopy from the folded position to the deployed position without requiring a user to step underneath since the handle is located at the outer periphery.

The elongate members are arranged in pairs that are attached to an upper corner bracket. The upper corner bracket is attached to the upper portion of the upper leg of the support legs. The pairs of elongate members are also attached to a sliding bracket that slides along the upper leg as the canopy transitions between folded and deployed positions.

The handle is removably secured to one of the support legs. When the canopy is folded, the handle is positioned near the upper portion of the upper leg. When the canopy is deployed, the handle is positioned near the lower portion of the upper leg. This placement of the handle facilitates easy operation during both deployment and retraction.

Each support leg is telescoping and consists of an upper leg and a lower leg. The upper leg has at least one hole, and the lower leg has multiple holes spaced along its length. A middle bracket is positioned between the upper leg and the lower leg. The middle bracket includes a pin that is removably inserted into the hole in the upper leg and any one of the holes in the lower leg. This arrangement allows the user to adjust the extension or retraction of the support legs to set a height of the canopy.

The lower leg includes a foot with a front portion and a rear portion. Both the front and rear portions are curved upward. These curved portions allow the foot to slide over the surface and traverse uneven obstacles. This design assists the user in deploying and folding the canopy with ease.

The canopy includes four support legs, one of which has a stationary foot. The stationary foot is configured to remain fixed in place when the canopy transitions between the folded and deployed positions. The support leg opposite the stationary foot includes a sliding foot. The sliding foot is aligned along a line extending from the stationary foot to the opposite leg. This alignment allows the opposite leg to move straight back during deployment. The other two support legs each have a sliding foot aligned along lines extending from the stationary foot to their respective legs. These alignments ensure the sliding feet can traverse uneven terrain during deployment and folding.

Each support leg may include a pair of wheels attached to the lower portion of the upper leg. The wheels are designed to facilitate rolling movement during deployment or retraction. The wheels are also aligned as discussed in relation to the sliding foot. The sliding foot and wheels allow the canopy to be easily deployed and collapsed.

The stationary foot includes a high-friction surface on its underside. This surface resists sliding and enhances stability during deployment and retraction.

The stationary foot may include a plurality of spikes extending from its bottom surface. The spikes are designed to penetrate the surface to further prevent movement and increase stability during deployment and retraction.

The sliding foot is positioned higher than the contact patch of the wheels with the surface when the lower leg is fully retracted into the upper leg. This configuration ensures the canopy can roll on the wheels without interference from the sliding foot.

The handle is attached to a latch located on the lower portion of the upper leg. The latch secures the handle in place and maintains the canopy in the deployed position when fully extended.

The elongate members may be pivotally connected at their ends using a pivoting bracket. The pivoting bracket includes a cavity that receives one end of an elongate member and a slot that receives the other end of another elongate member. As the canopy transitions from folded to deployed, the angle between the elongate members increases. In the deployed position, one elongate member engages the slot in the bracket, reinforcing the connection and enhancing structural integrity.

The deployment process involves pulling the handle to tension the cable while standing outside the canopy's periphery. The tensioned cable draws the lower hub closer to the upper hub, pivoting the elongate members and pushing the support legs outward. During folding, the reverse process is used. The support legs slide on their feet or roll on wheels, and the stationary foot remains fixed for stability. Adjustments to the telescoping legs allow the user to set the desired height by aligning and locking the legs using the middle bracket. The sliding feet and wheels work together to navigate uneven terrain. The canopy design ensures smooth operation during deployment and retraction without requiring the user to step under the canopy.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
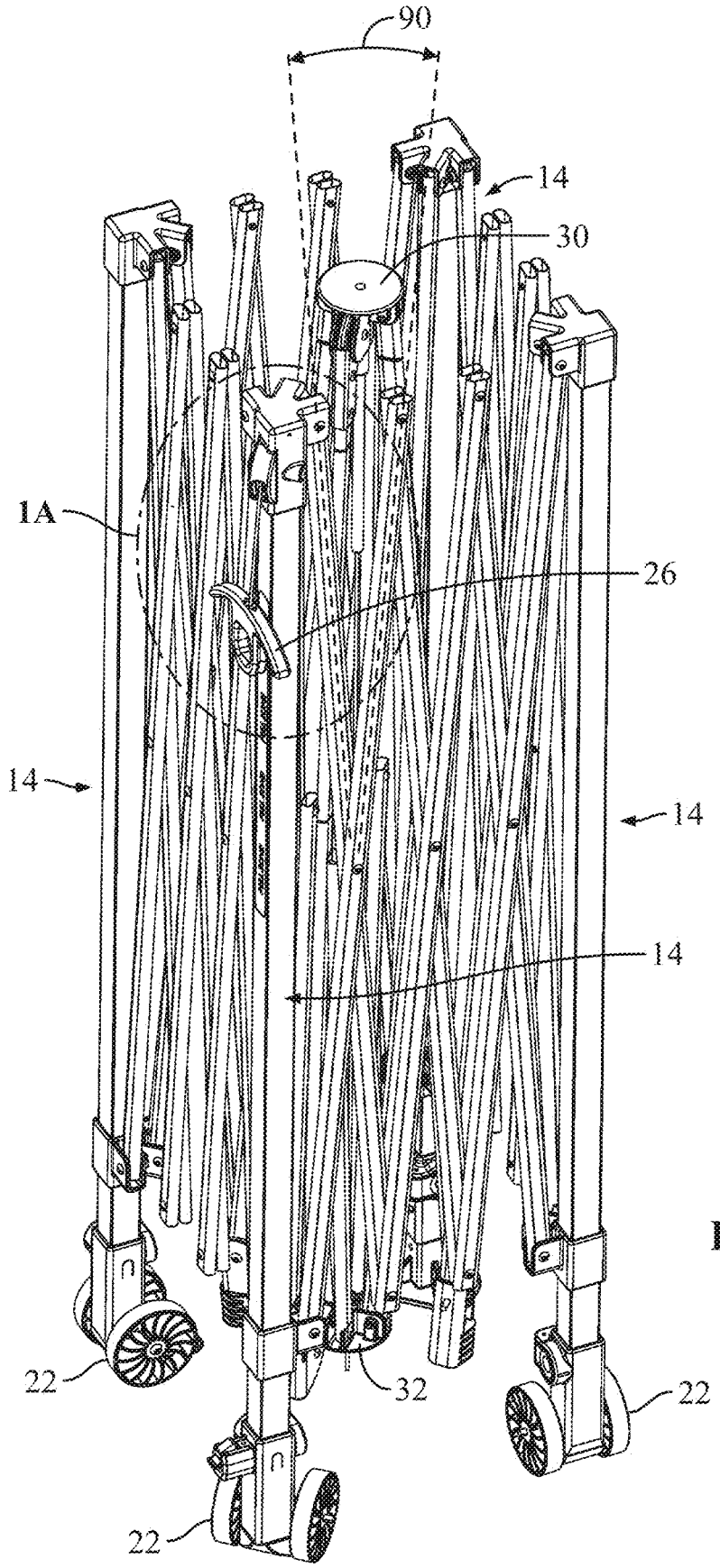
FIG. 1 illustrates the canopy in its fully folded position, showing the compact arrangement of the support legs, elongate members, and central hubs.

The various aspects described herein relate to a folding canopy 10 designed for ease of use by a single person. The canopy 10 includes a pull handle 26 (see FIG. 3C) operatively connected to a cable 42 and a series of pulleys 44, which allows a single user to traverse the canopy 10 from a folded position to a fully deployed position without the need to walk underneath the structure. The canopy 10 is supported by a plurality of telescoping legs 14, three of which has wheels 22 for easy rolling movement during deployment and retraction, while one leg includes a stationary foot 20 with a high-friction surface 82 (see FIG. 8C) to prevent sliding during use. This combination of a stationary foot 20, rolling feet 22, and the pull handle 26 ensures the canopy 10 can be deployed and retracted by a single user, even over uneven terrain.

Figure 7:
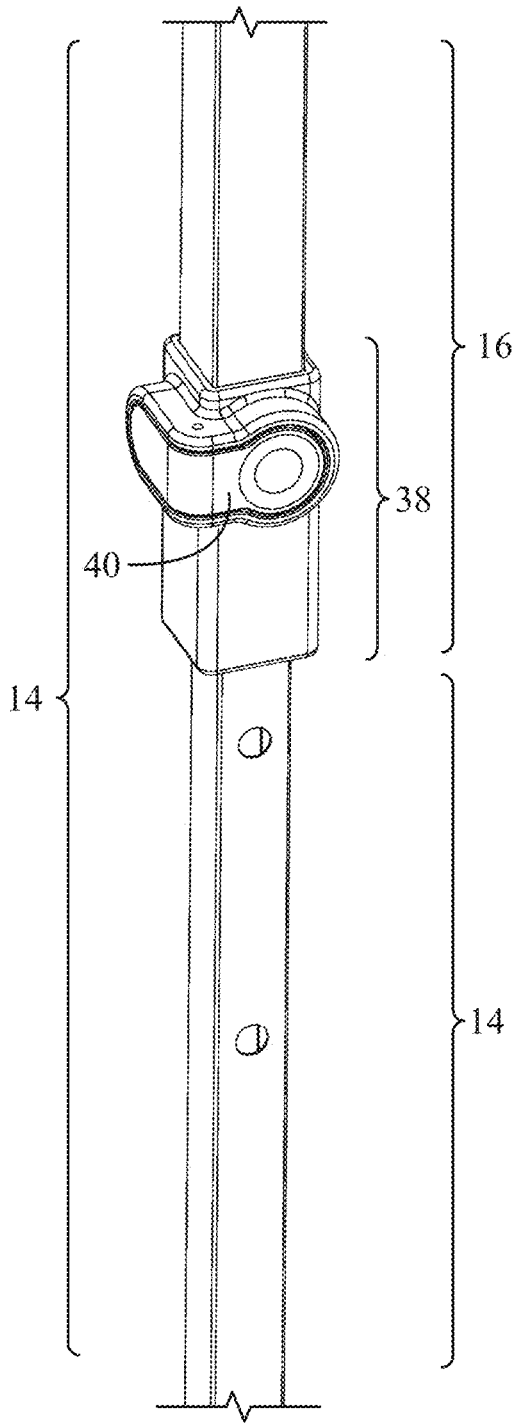
FIG. 7 illustrates the middle bracket connecting the upper and lower legs, allowing for telescoping adjustment.
Figure 7A:
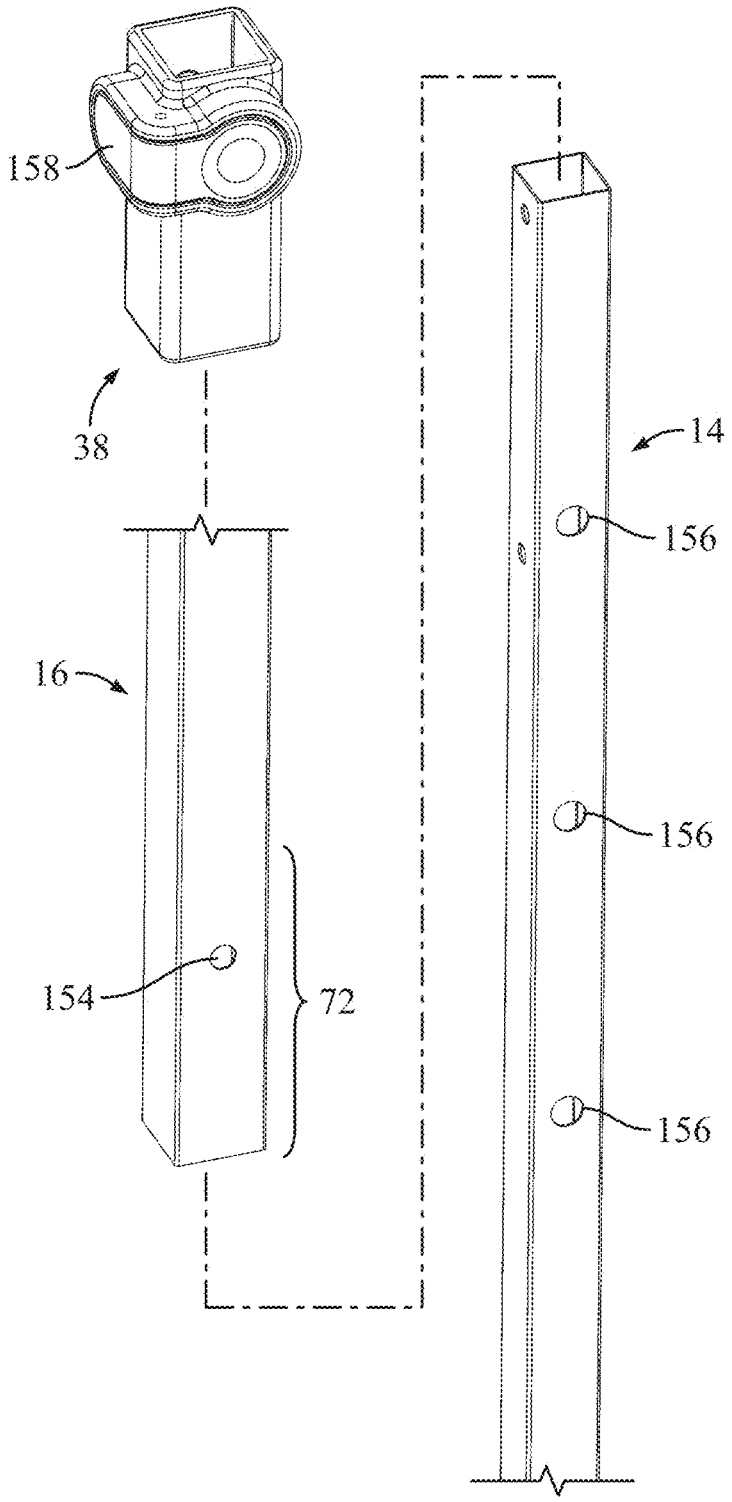
FIG. 7A illustrates a close-up view of the middle bracket, showing the trigger mechanism for locking the telescoping legs.

More particularly, the folding canopy 10 is a structure configured to provide shade when in a deployed position and fold into a compact, stored configuration when in a folded position for storage. The canopy 10 comprises a plurality of telescoping support legs 14, each consisting of an upper leg 16 and a lower leg 18, as shown in FIGS. 7 and 7A. These legs 14 are adjustable in length and configured to support the canopy 10 on a surface 64, which may include uneven terrain such as grass or rocky ground. The lower leg 18 includes a foot 20 (see FIG. 8B), which in some cases may be stationary and equipped with a high-friction surface 82 to help the user traverse the canopy 10 to a fully deployed configuration during use and to traverse the canopy back to a folded position for storage. The other legs 14 may include sliding feet 20 and wheels configured to move across the surface 64, facilitated by their curved front 74 and rear 76 portions with upward curvature 62.

Figure 5A:
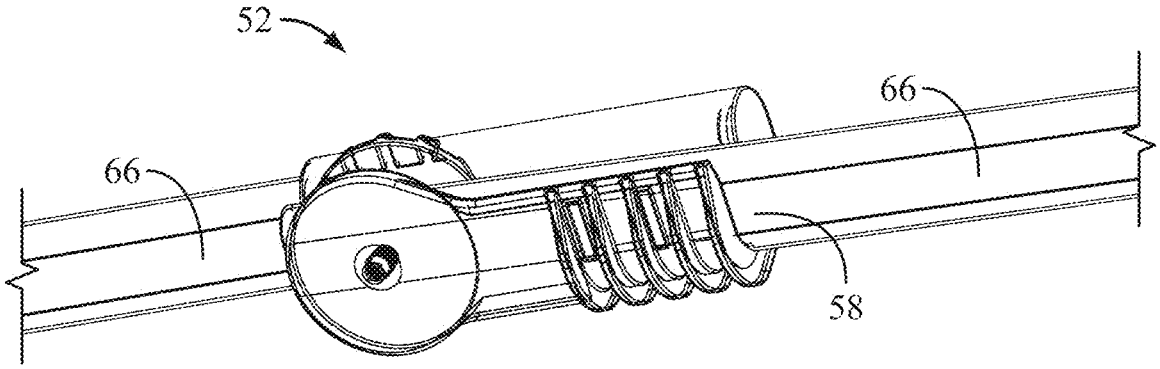
FIG. 5A illustrates a close-up view of a pivoting bracket, showing the cavity and slot for receiving the elongate member.
Figure 6:
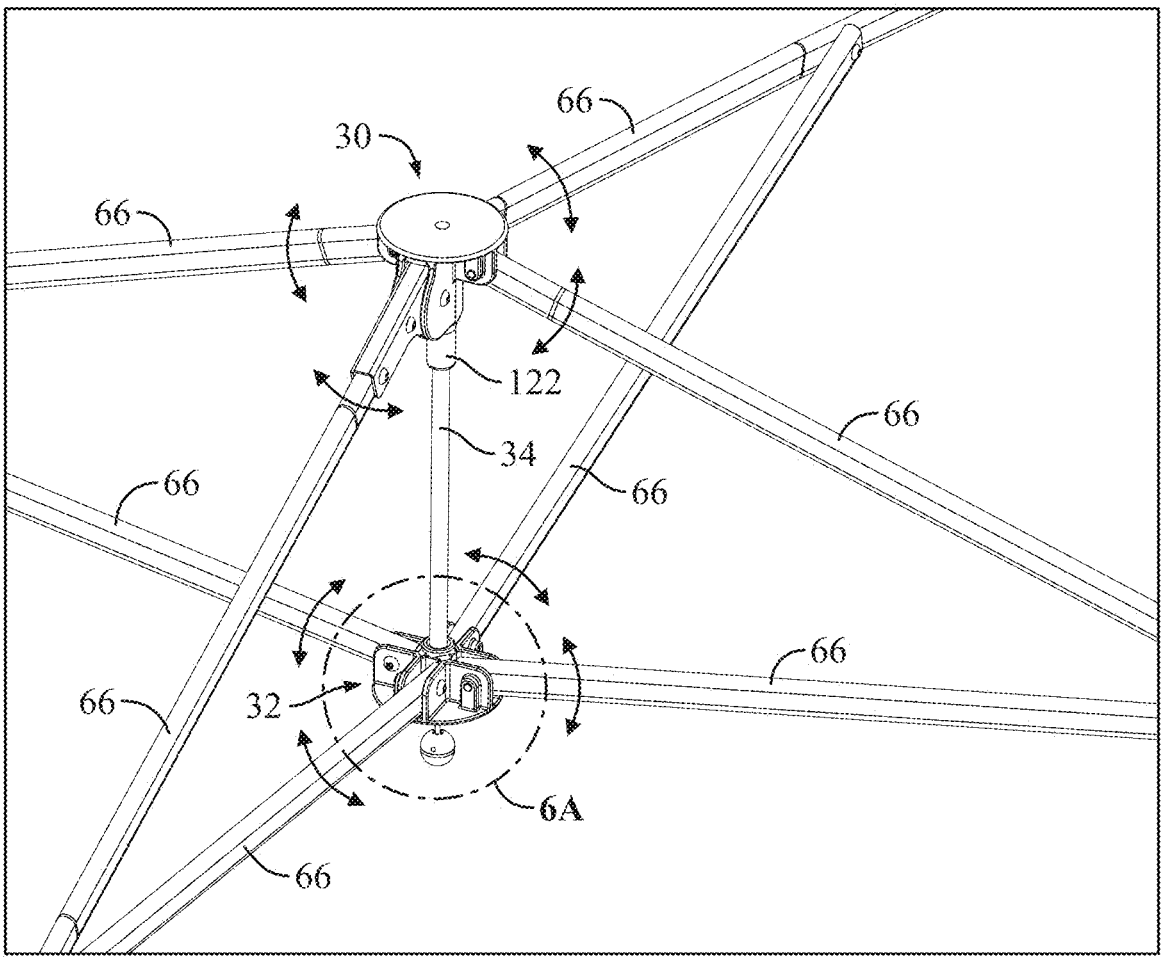
FIG. 6 illustrates a spacer positioned between the central upper and lower hubs, maintaining spacing therebetween during deployment.

The canopy 10 is initially traversed to the deployed configuration by pulling the support leg opposite the stationary support leg away from the stationary support leg. When the user has traversed the canopy about 75% to the fully deployed position, the user traverses the canopy to the fully deployed position by pulling on the handle. By doing so, a central lower hub 32 is drawn toward a central upper hub 30, which was initially fully separated when the canopy 10 is in the folded position. As shown in FIG. 6, the central hubs 30 and 32 are connected to a plurality of elongate members 66, which are tubular to minimize weight while maintaining structural strength. The elongate members 66 are pivotably connected to one another. Some of the elongate members 66 form pairs of tubular members 66 (see FIG. 2) that pivot with respect to each other. Each pair includes a first elongate member 66 pivotably attached to the central upper hub 30 and a second elongate member 66 pivotably attached to the central lower hub 32. Other first and second elongate members 66 are pivotably connected to each other via stabilizing brackets 52 (see FIG. 5A), allowing controlled pivoting and reinforcement during deployment.

The elongate members 66 are configured such that when the central lower hub 32 is drawn closer to the central upper hub 30, the elongate members 66 push the support legs 14 outward. This action transitions the canopy 10 from the partially folded position to the fully deployed position. Other pairs 68 of elongate members 66 are attached to the support legs 14 to stabilize the canopy 10 in the deployed position. Specifically, as shown in FIG. 3B, the elongate members 66 are connected to the upper portion 70 of the upper leg 16 via an upper corner bracket 28, and to the lower portion 72 of the upper leg 16 via a sliding bracket 48. As shown in FIG. 1B, the upper corner bracket 28 houses pulleys 44 and apertures 94 through which pins 96 are inserted to define rotational axes for the pulleys 44 and the elongate members 66.

The canopy 10 includes a handle 26 (see FIG. 3C) positioned adjacent to one of the support legs 14. Preferably, the support leg directly opposite the stationary support leg 14 or any of the other stationary support leg 14. The handle 26 is connected to a cable 42, which is routed to the central upper hub 30 and down to the central lower hub 32 via a series of pulleys 44. The cable 42 is attached to the central lower hub 32 and, when tensioned by pulling the handle 26, applies an upward force to the central lower hub 32. This force draws the central lower hub 32 toward the central upper hub 30, thereby activating the elongate members 66 to extend the support legs 14 outward.

A series of pulleys 44 are placed to guide the cable 42 during this operation. The cable is shown as being internally routed in the tubular members 66 but it is also contemplated that the cable may be externally routed. Pulleys 44 are mounted to the upper corner brackets 28, pivoting joints of the elongate members 66, and the central upper hub 30. This arrangement ensures that the cable 42 is routed efficiently and reduces friction during the deployment process.

The pull handle 26 and cable 42 enable a single user to operate the canopy 10 without the need to walk underneath the structure. Once the canopy 10 reaches the deployed position, the handle 26 is secured onto a latch 84 on one of the support legs 14 to maintain tension in the cable 42 and lock the canopy 10 in the deployed position. This arrangement eliminates the need for additional tools or external assistance to secure the canopy 10 during use.

The canopy 10 is equipped with three legs 14 that include wheels 22, allowing the user to easily roll those support legs during deployment or retraction to the folded position. For the rolling support legs, the wheels 22 may be attached to the lower portion 72 of the upper leg 16 via brackets 38 (see FIGS. 3C and 8A), which allow the wheels 22 to rotate freely. The stationary foot 20 on the fourth leg 14 is configured to prevent unintended movement during operation so that a single person can deploy and fold the canopy. The user can walk backwards while the stationary support leg 14 remains in position. The other three support legs having wheels and curved feet roll over the terrain. The user then pulls the canopy to the fully deployed position for the last about 25% of the travel and locks the canopy in place by pulling the handle and attaching the handle to the latch.

Additionally, a spacer 34 is positioned between the central upper hub 30 and the central lower hub 32 to prevent the central lower hub 32 from getting too close to the central upper hub 30. If it is too close, then the members would become over-center and lock into place which would prevent the canopy from being collapsible unless someone imparts a force to bring it back from the over center position.

The canopy 10 includes a cover 12 (see FIG. 3), which provides shade and protection from sunlight. The cover 12 is supported by the elongate members 66 in the deployed position, forming a stable and tensioned configuration that effectively shelters the area beneath it. When not in use, the canopy 10 may be stored in a bag to prevent dust accumulation, with the telescoping legs 14 fully retracted and the elongate members 66 folded inward. In the folded position, the canopy 10 occupies minimal space during storage or transport.

Figure 2:
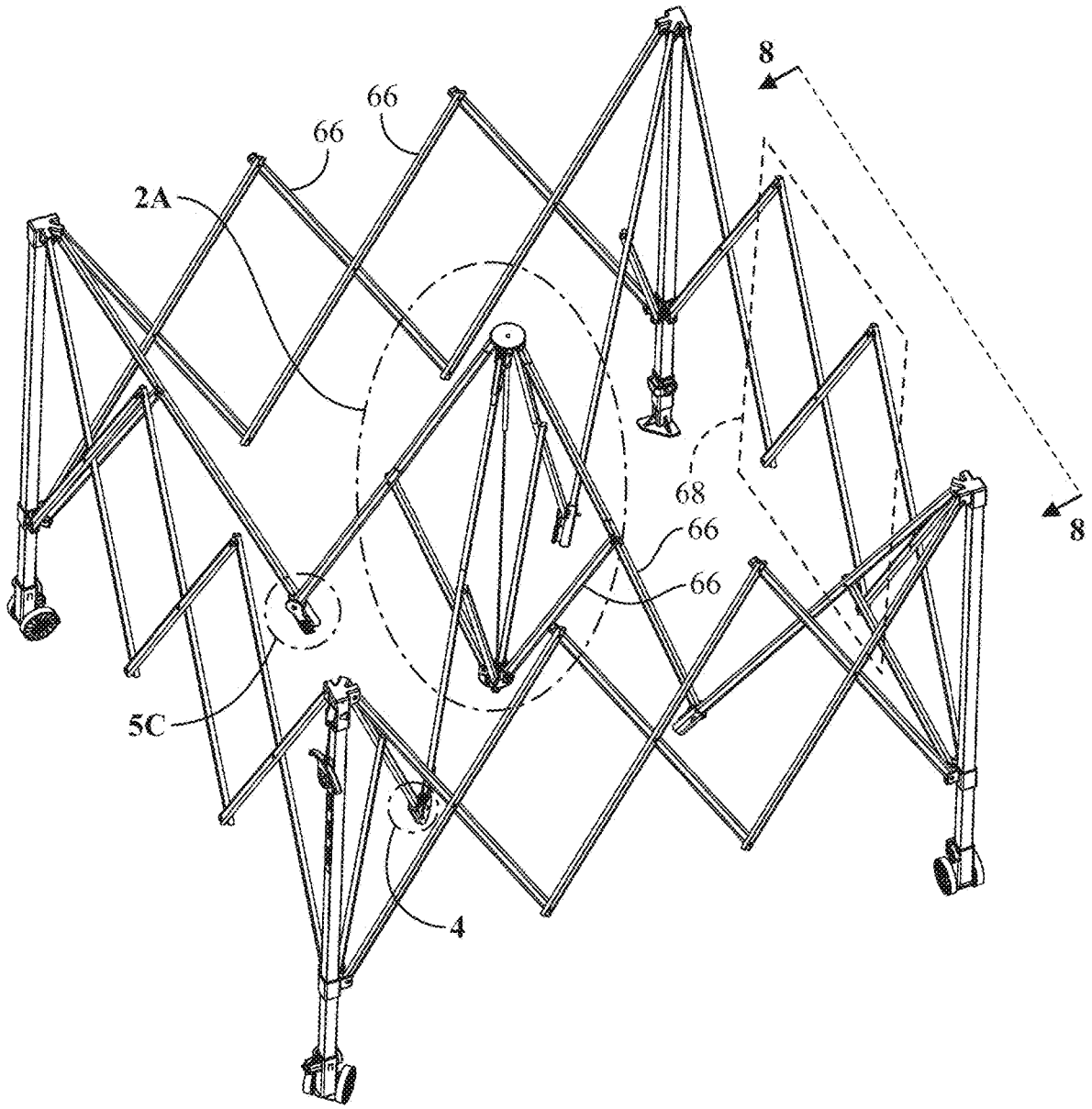
FIG. 2 illustrates the canopy in a partially deployed position, highlighting the outward movement of the elongate members and support legs.
Figure 3:
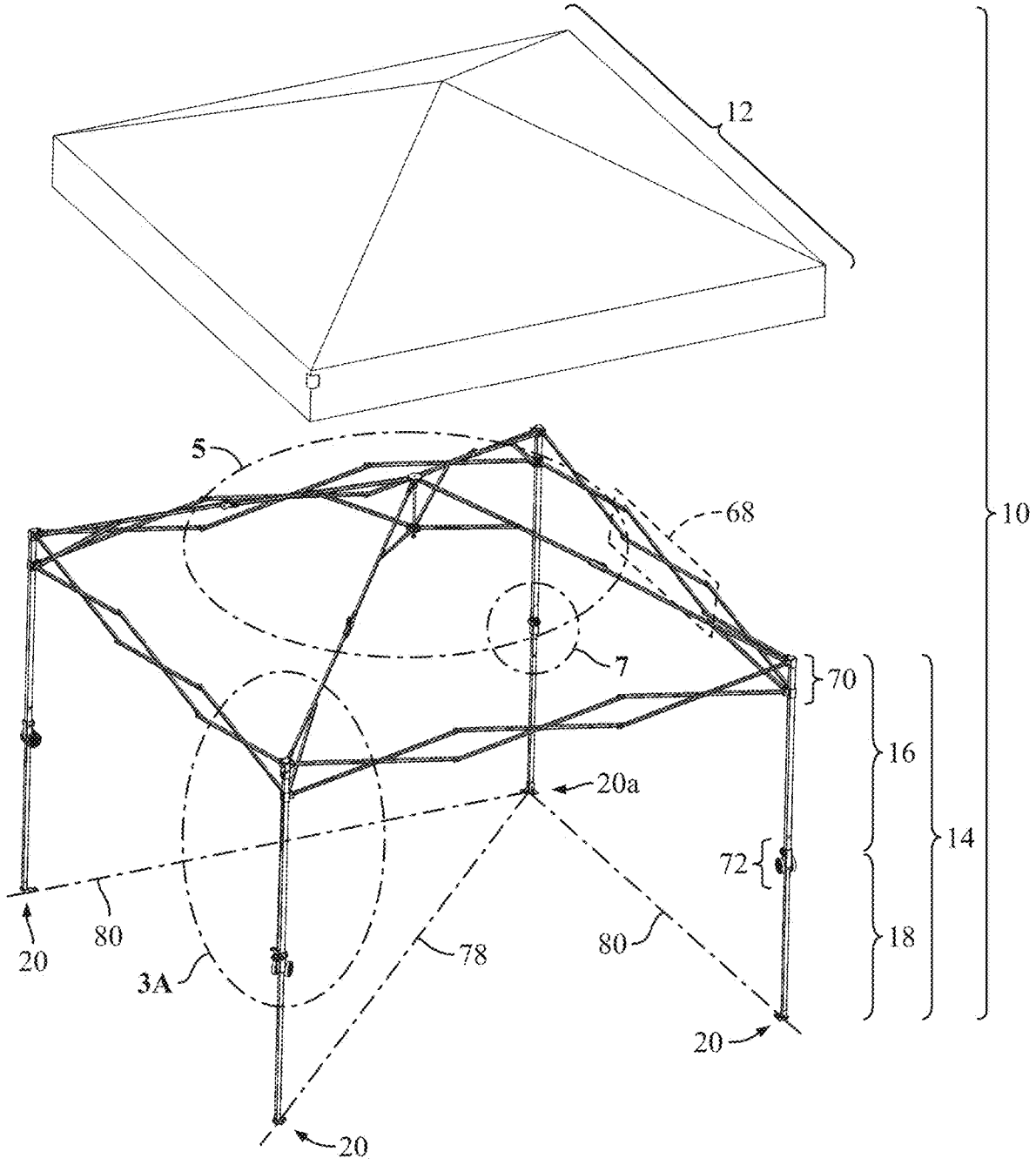
FIG. 3 illustrates the canopy in its fully deployed position, with the elongate members fully extended and the cover exploded off of the structure.

Referring now to FIGS. 1, 2, and 3, these figures illustrate the progression of the canopy 10 as it transitions from the folded position to the fully deployed position, highlighting the dynamic change in the angle 90, 92 (see FIGS. 1 and 3A) formed between the elongate members 66.

FIG. 1 depicts the canopy 10 in its folded position. In this configuration, the angle 90 between the elongate members 66 is minimized. Additionally, as shown in FIG. 6, the elongate member 66 is pivotably connected to the central upper hub 30, while the second elongate member 66 is pivotably connected to the central lower hub 32. Elongate members 66 of the canopy may also be pivotably attached to each other via stabilizing brackets 52 (see FIG. 5A). Other elongate members 66 may form pairs 68 (see FIG. 2). In the folded position, the central upper hub 30 and the central lower hub 32 are spaced apart, as shown in FIG. 1, resulting in a collapsed structure where the angle 90 is relatively small, reflecting the compact arrangement of the canopy 10 for storage or transport.

FIG. 2 demonstrates an intermediate stage as the canopy 10 is traversed from the folded position toward the fully deployed position. During approximately, the last 25% of the travel to the deployed position, as the handle 26 is pulled, tension is applied to the cable 42, which draws the central lower hub 32 closer to the central upper hub 30. This action causes the elongate members 66 to pivot about their respective stabilizing brackets 52 and connection points at the hubs 30 and 32. As the elongate members 66 pivot outward, the angle 92 (see FIG. 3A) between the first and second elongate members 66 increases. This pivotal movement drives the telescoping support legs 14 outward, expanding the canopy structure.

FIG. 3 illustrates the canopy 10 in its fully deployed position. In this configuration, the angle 90, 92 between the elongate members 66 has reached its maximum, representing a stable and reinforced structure. The central upper hub 30 and central lower hub 32 are now closer together. The elongate members 66 are extended outward, and supports the cover 12.

Figure 3A:
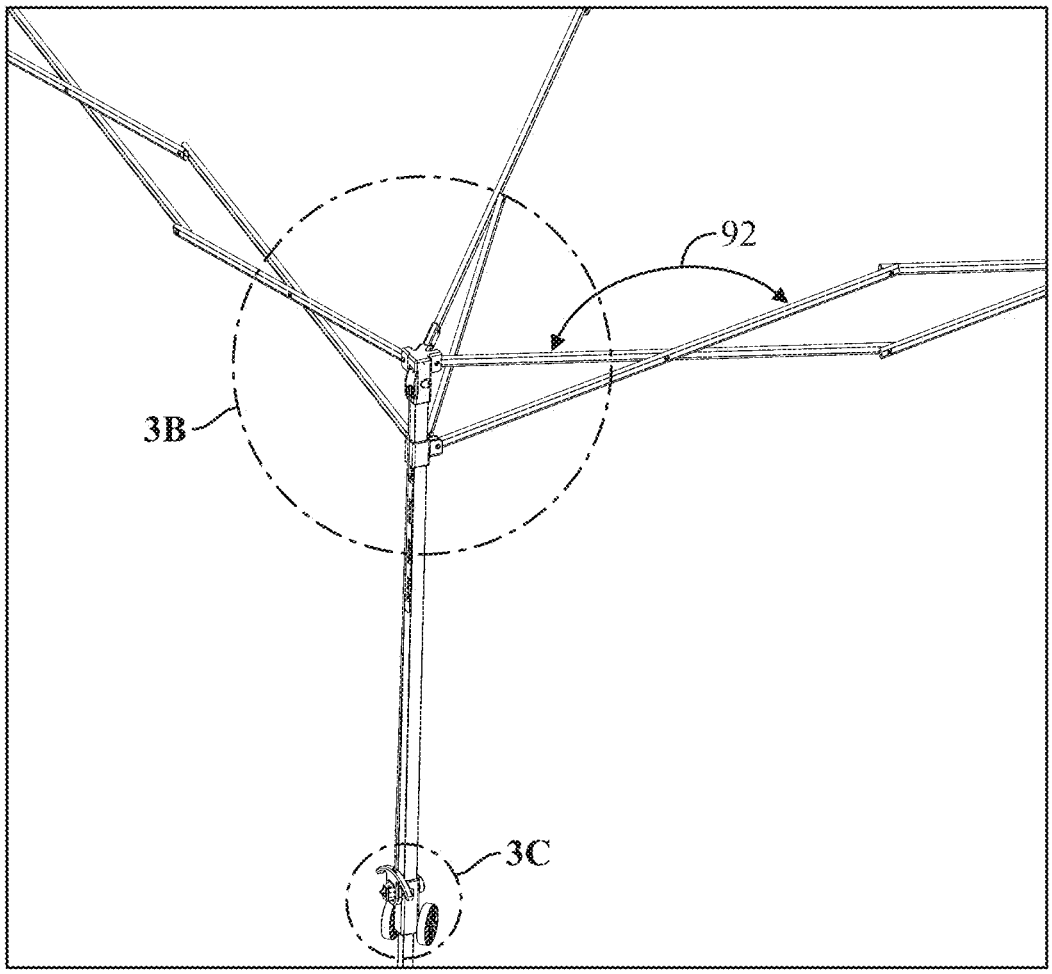
FIG. 3A illustrates the upper corner bracket in the deployed position, highlighting the angles of the elongate members.
Figure 3B:
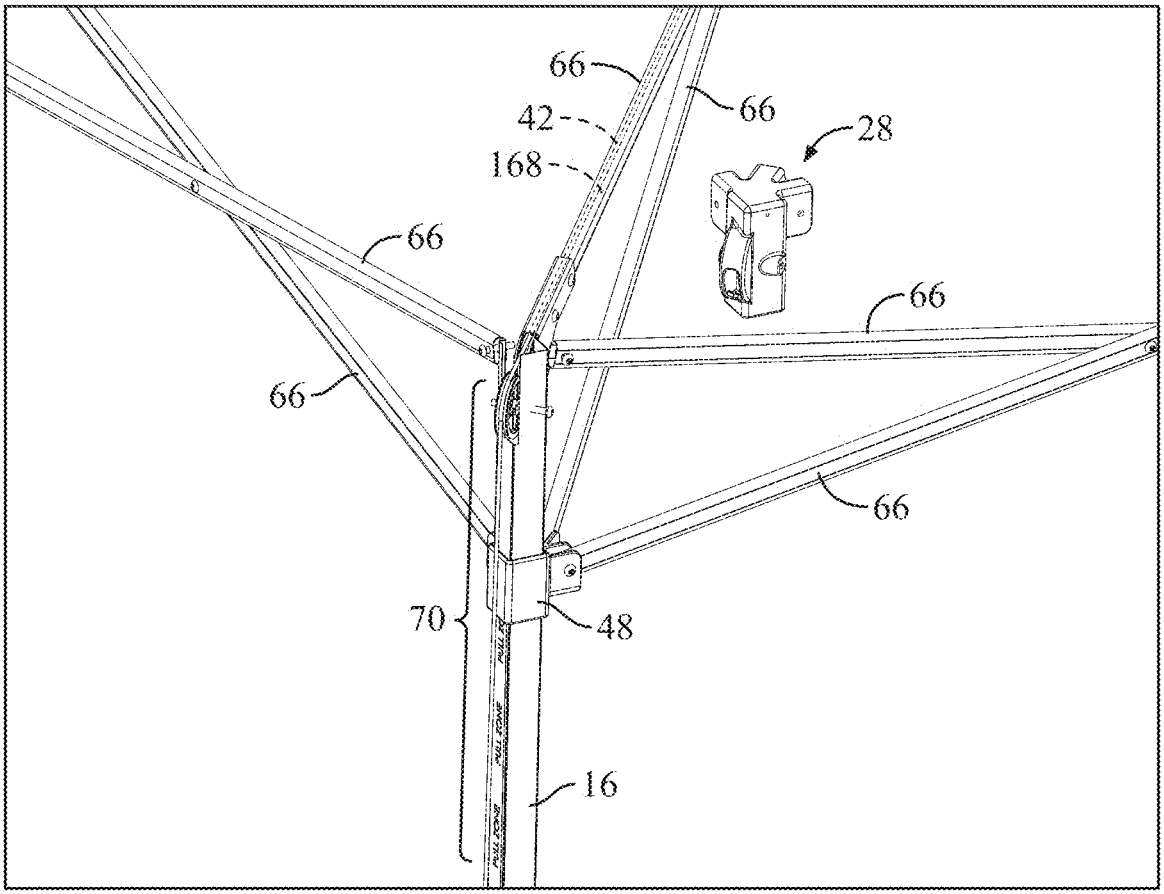
FIG. 3B illustrates the internal structure of the upper portion of the upper leg when the upper corner bracket is removed, showing the cable routing.

The progression of angle 90, from its minimal value in the folded position shown in FIG. 1 to its maximum in the deployed position shown in FIGS. 3 and 3A illustrates the deployment process. This change is achieved by the pivotal movement of the elongate members 66, facilitated by the traversal of the central lower hub 32 toward the central upper hub 30.

Referring now to FIGS. 1A, 1B, 1C, 1D, and 1E, the same provide detailed views of the upper corner bracket 28 and illustrate how the cable 42 is routed through the structural components, including its transition into the hollow cavity 168 (see FIG. 1D) of the tubular elongate member 66. These figures highlight key structural and functional features that facilitate the deployment and operation of the canopy 10.

Figure 1A:
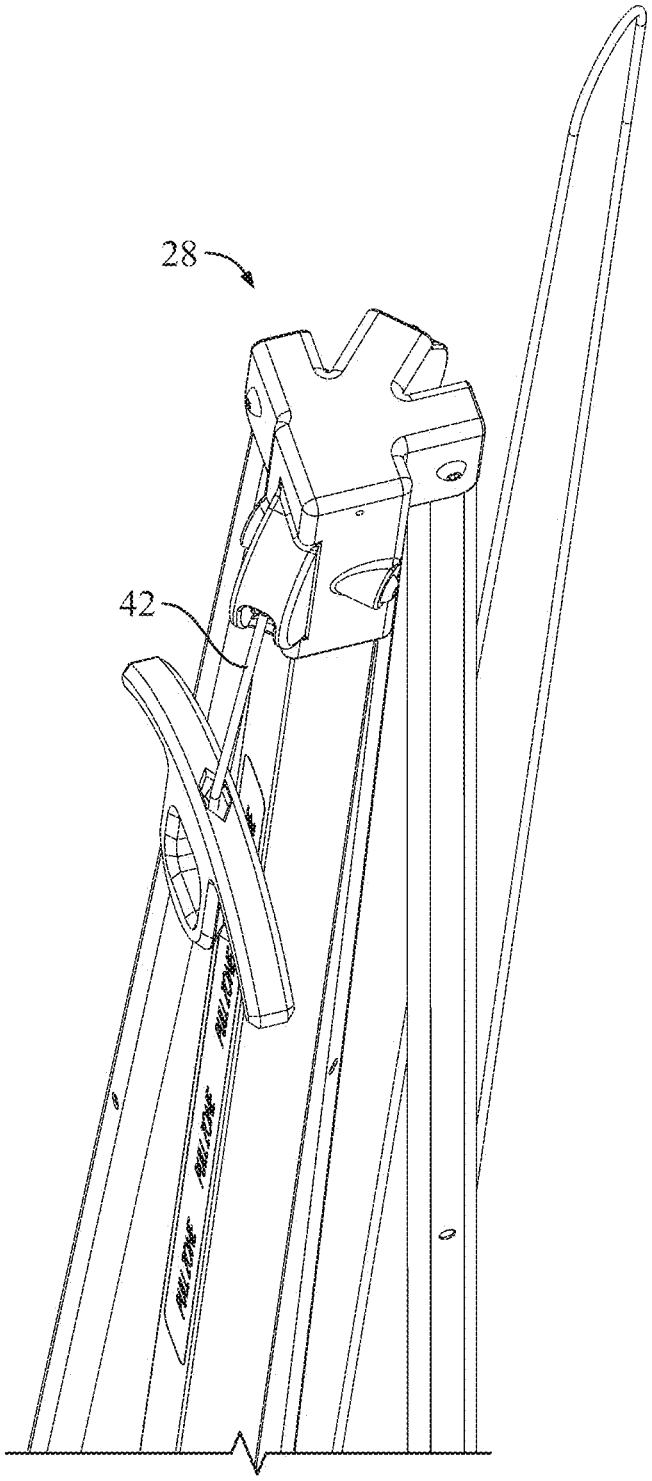
FIG. 1A illustrates a perspective view of the upper corner bracket and its connections to the upper leg, pulleys, and cable system.
Figure 1B:
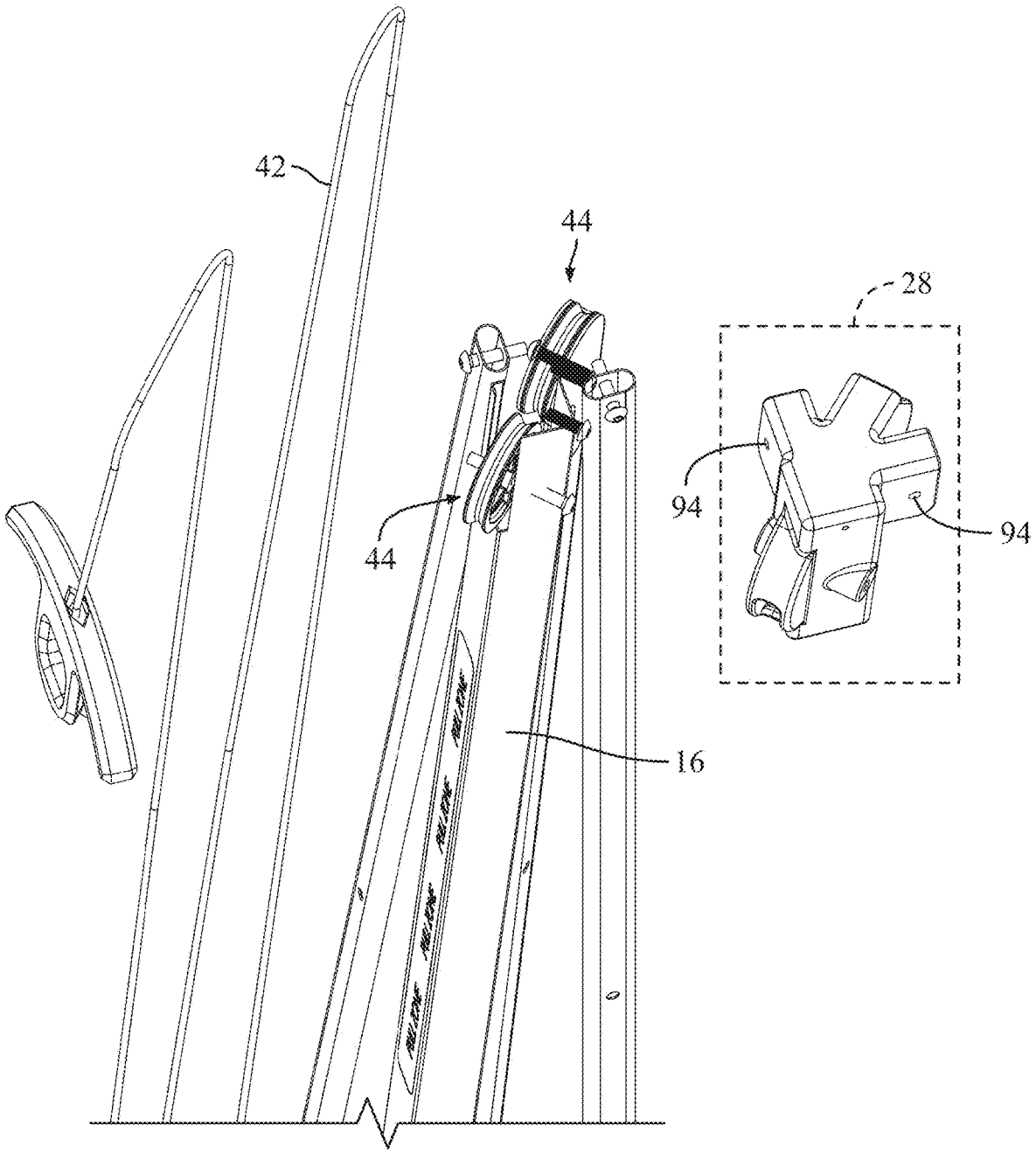
FIG. 1B illustrates a close-up view of the routing of the cable through the pulley mounted on the upper corner bracket.

FIG. 1A shows an overall perspective of the upper portion of the canopy 10, with the cable 42 extending vertically toward the upper corner bracket 28 from the handle 26. The cable 42 is operatively connected to the handle 26 and routed through the upper corner bracket 28 to exert force on the central lower hub 32 toward the central upper hub 30. As the handle 26 is pulled, the tensioned cable 42 drives the deployment of the canopy 10.

FIG. 1B provides a closer view of the routing of the cable 42 and its interaction with the upper corner bracket 28. The cable 42 is guided over the pulleys 44, which is rotatably attached to the upper corner bracket 28. One is positioned on the outer side of the upper leg and the other is positioned on the inner side of the upper leg. The cable 42 is routed over the upper leg 16 and guided into the hollow cavity 168 (see FIG. 1D) of the elongate member 66. The upper corner bracket 28 has a plurality of apertures 94 through which pins 96 (see FIG. 1C) are inserted to hold the pulleys and define rotational axes for the pulleys 44 and the elongate members 66. These rotational axes enable the pivoting motion of the elongate members 66 as the canopy transitions between folded and deployed positions.

Figure 1C:
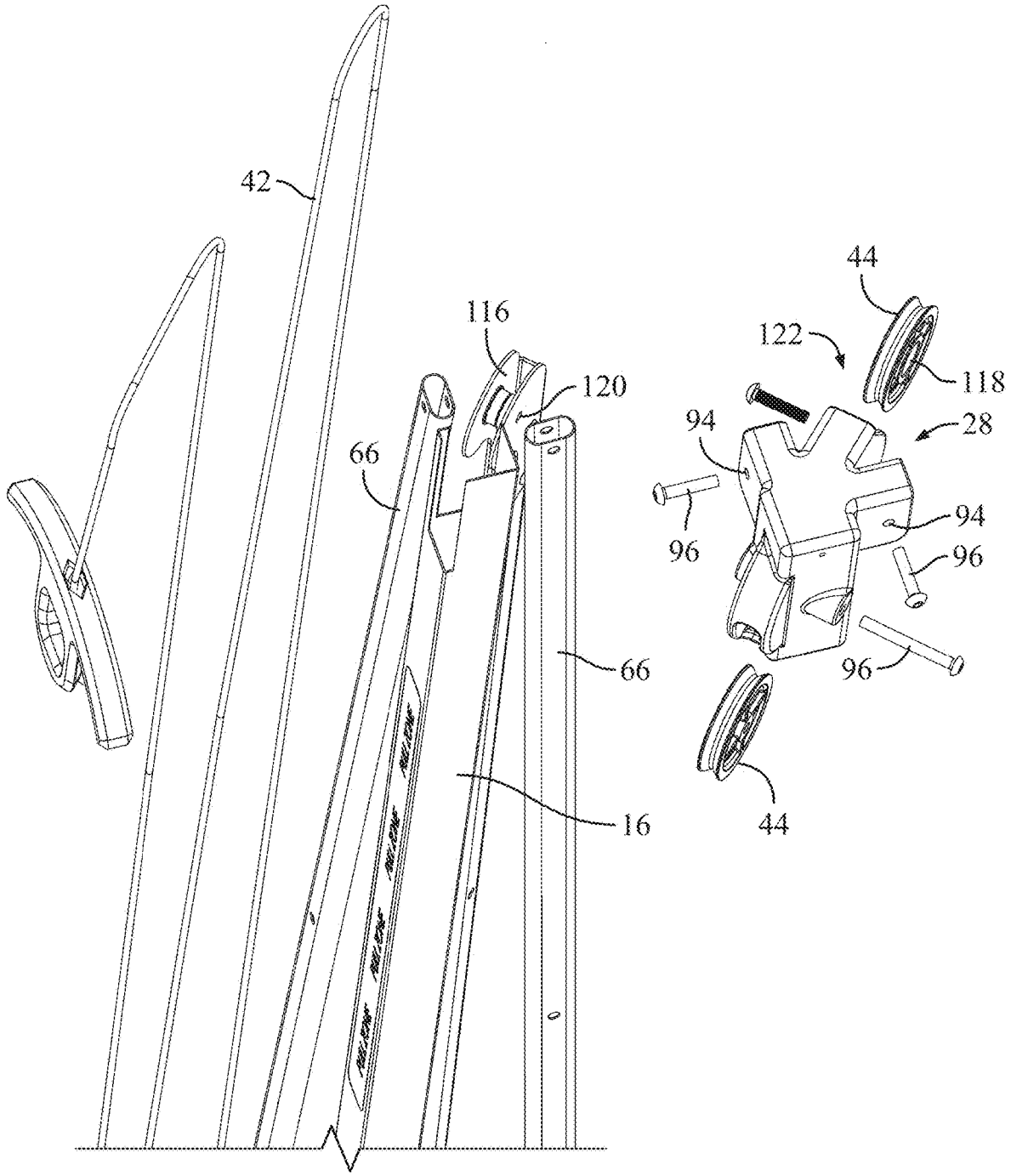
FIG. 1C illustrates the connection of the upper corner bracket to the upper portion of the upper leg and the integration of the pulley system.

FIG. 1C illustrates the integration of the upper corner bracket 28 with the upper portion 70 (see FIG. 1D) of the upper leg 16. The cable 42 is routed through the upper corner bracket 28, over the pulleys 44 and enters the hollow cavity 168 of the elongate member 66 which is oriented toward the central upper and lower hubs 30, 32. This design ensures that the cable 42 is enclosed, reducing the risk of external interference. The figure also shows how the pulley 44 is rotatably attached to the upper corner bracket 28, allowing smooth movement of the cable 42 when the user pulls on the handle and when the cable is retracted during folding.

Figure 1D:
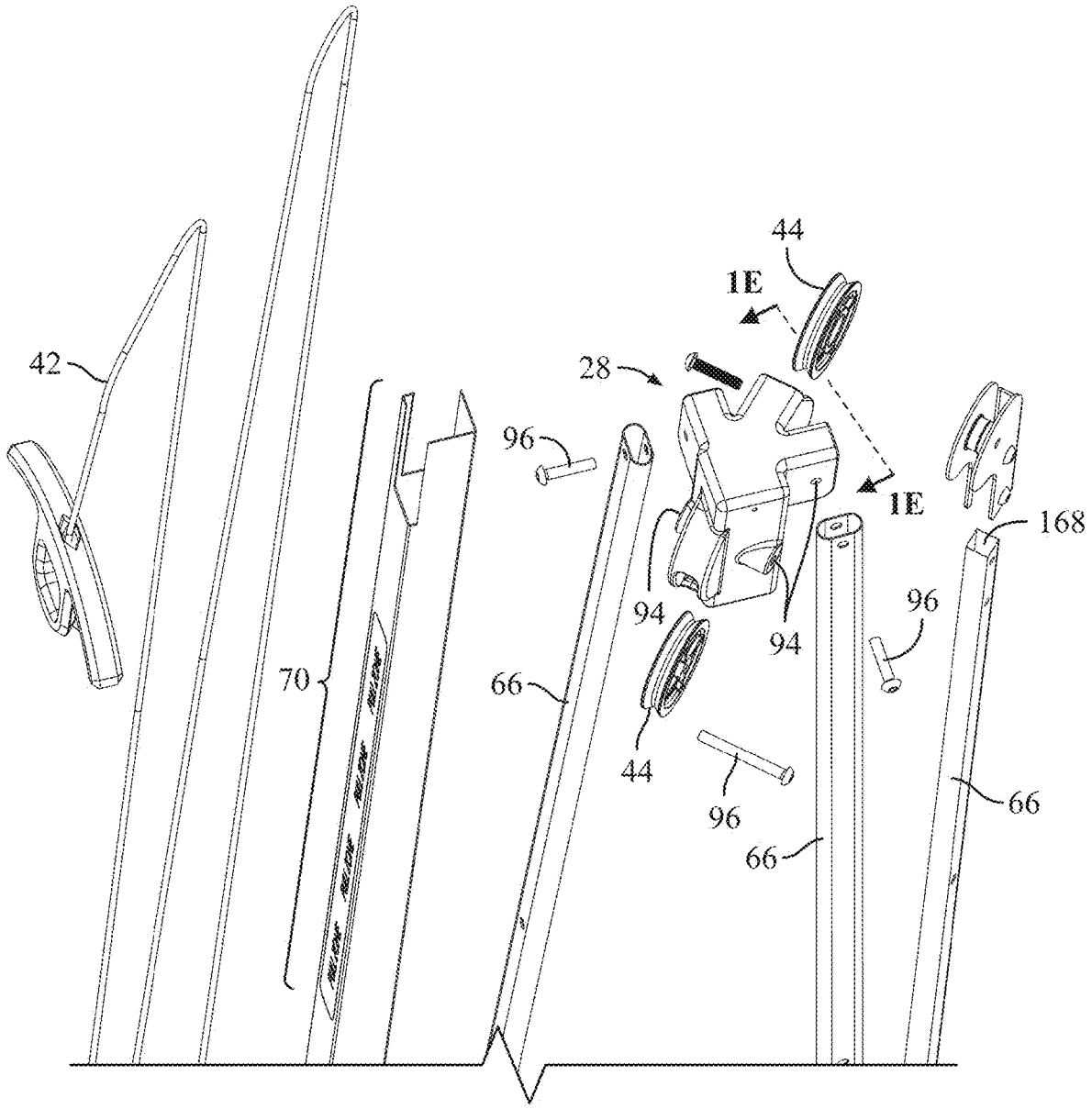
FIG. 1D illustrates an exploded view of the upper corner bracket and its components, including the apertures, pins, and pulley.

FIG. 1D provides a further exploded view of the upper corner bracket 28, illustrating the alignment of components for assembly. The pulley 44 is inserted into the bracket 28 and aligned with its respective apertures 94. Pins 96 secure the pulley 44 in place, ensuring that it rotates freely as the cable 42 is tensioned. This figure also shows the routing of the cable 42 over the pulley 44 before it transitions into the hollow cavity 168 of the elongate member 66.

Figure 1E:
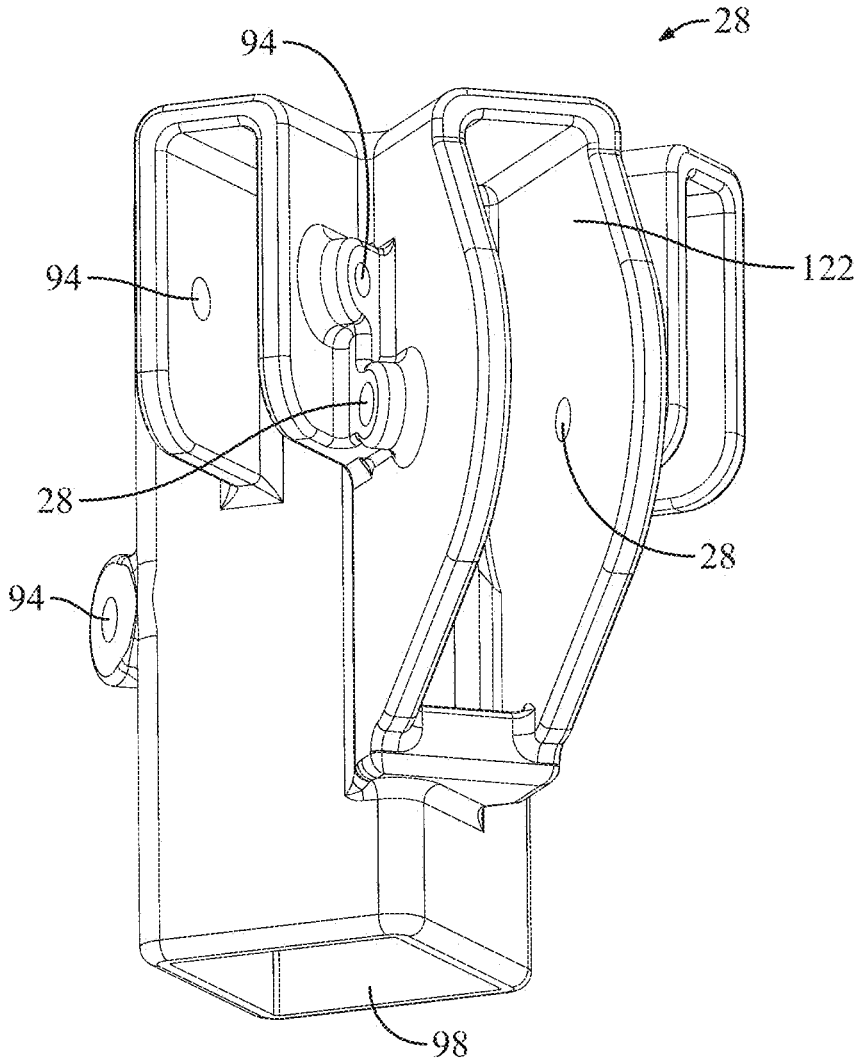
FIG. 1E illustrates the slots of the upper corner bracket.

FIG. 1E focuses on the detailed structure of the upper corner bracket 28. The cavity 98 of the upper corner bracket 28 receives the upper portion 70 of the upper leg 16, creating a connection therebetween. The upper corner bracket 28 has three slots. The two outer slots receives the elongate members which extend out to the other support legs. The middle slot receives the pulley 44 and the elongate member 66. The cable is routed over the pulley at the outer side of the upper leg 16 as shown in FIG. 1D, the pulley 44 disposed within the middle slot shown in FIG. 1E, and into a cavity 168 (see FIG. 1D) of the elongate member 66. The elongate member rotateably attached to the middle slot extends toward the central upper and lower hubs 30, 32. This arrangement allows the cable 42 to transition smoothly from the external pulley 44 and over internal pulley then into the internal cavity 168 of the elongate member, protecting the cable for snagging during repeated use of the canopy and protection from external elements.

These figures collectively demonstrate the structure of the upper corner bracket 28 in guiding the cable 42 and connecting the elongate members 66 and upper leg 16. By routing the cable 42 over the pulleys 44 and into the hollow cavity 98 of the tubular elongate members 66, the system achieves efficient force transmission, contributing to the smooth deployment and retraction of the canopy 10. This design ensures that the cable 42 is securely enclosed and that the elongate members 66 are properly supported and aligned during operation.

Figure 2A:
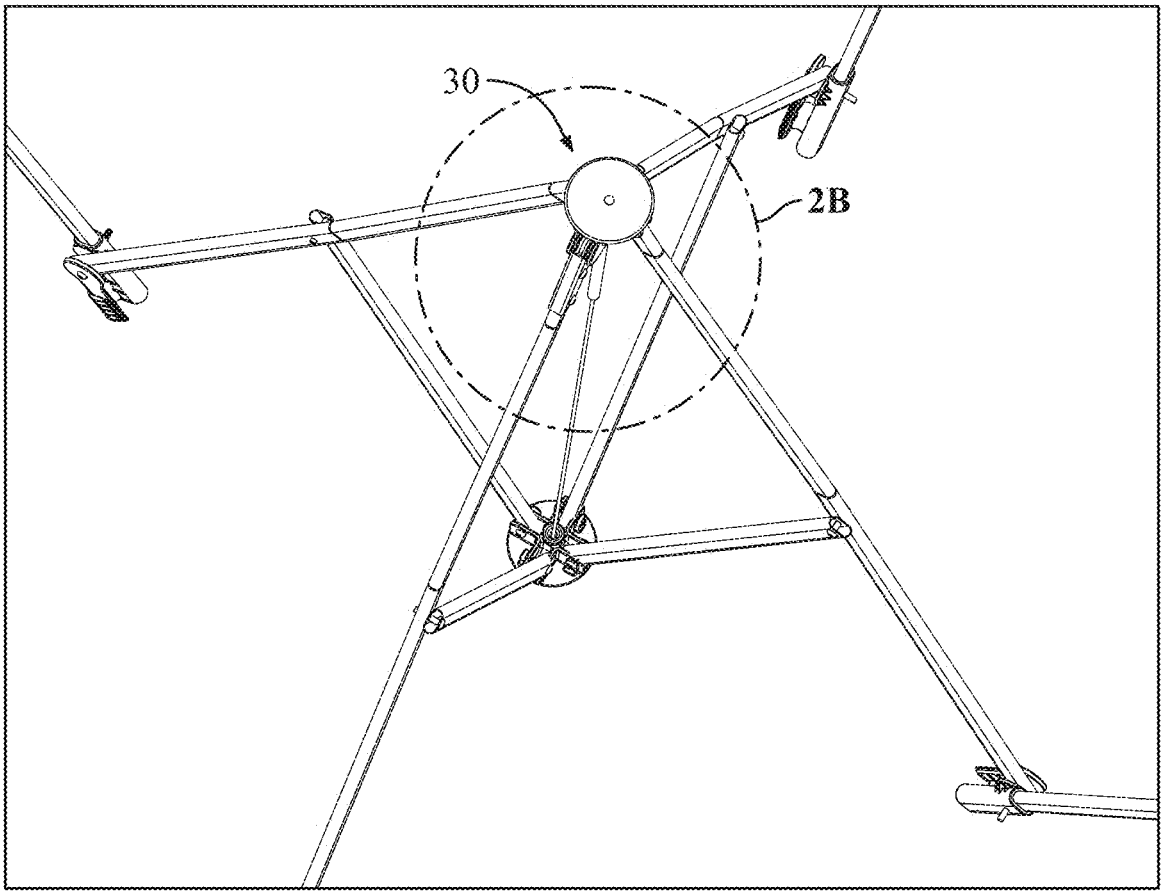
FIG. 2A illustrates a closer view of the central upper hub, showing its connection to the first elongate members and its role in guiding deployment.
Figure 2B:
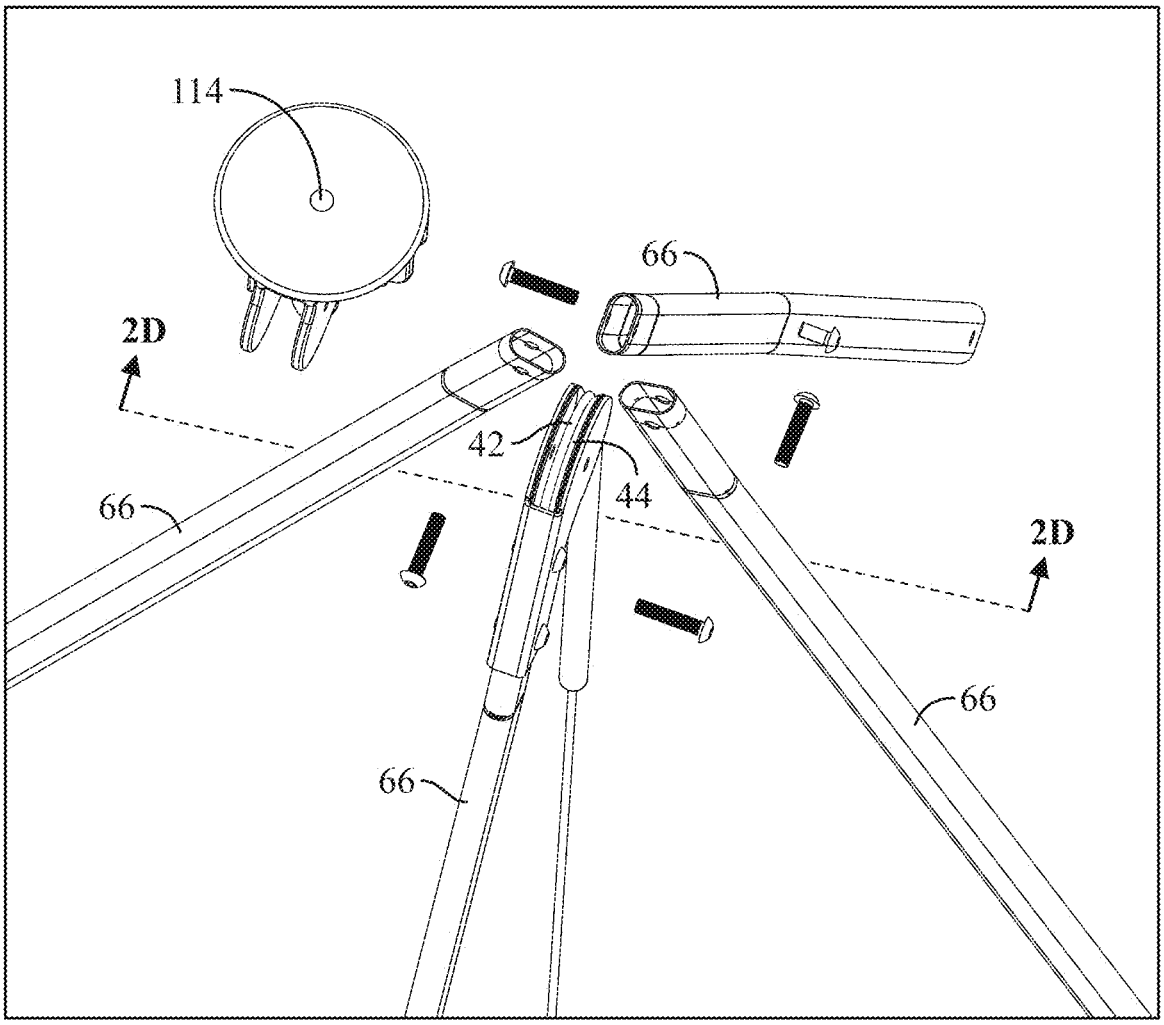
FIG. 2B explodes the elongate members pivotally attached to the central upper hub and the routing of the cable through the system.
Figure 2C:
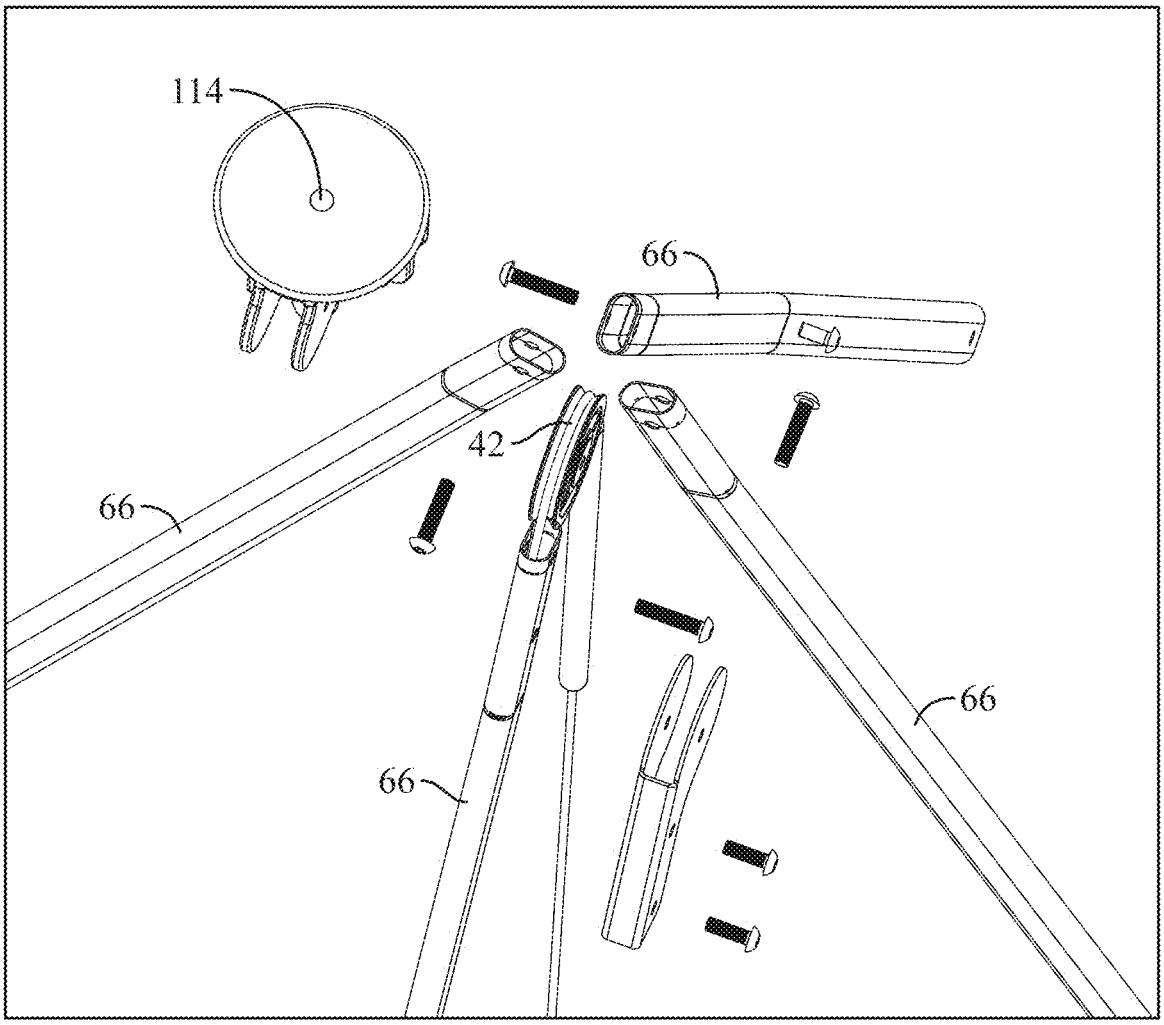
FIG. 2C further explodes the elongate members to the central upper hub, with details of the connection points.
Figure 2D:
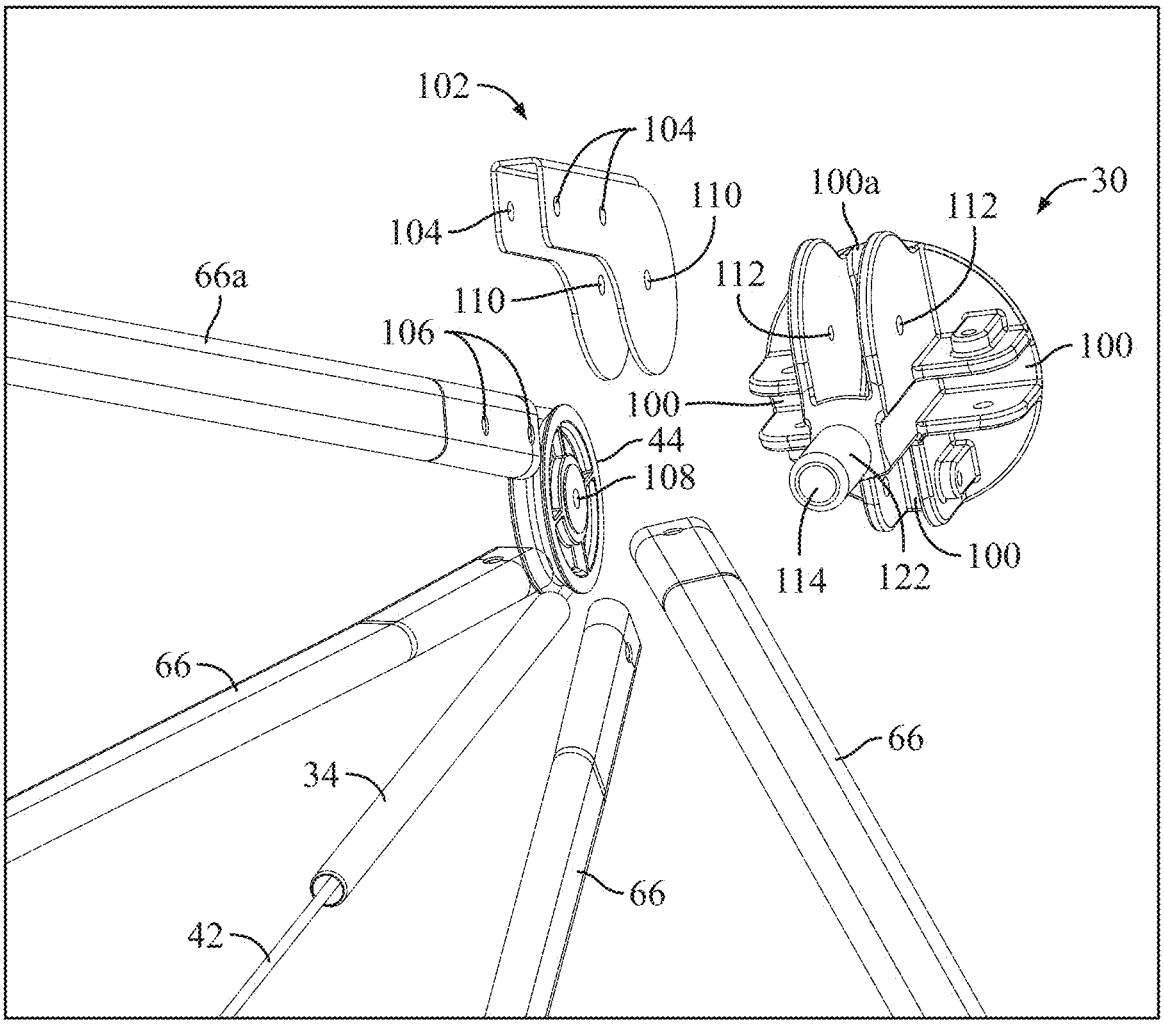
FIG. 2D illustrates an exploded view of the central upper hub, showing how the elongate members and cable system integrate with the hub.

Referring now to FIGS. 2 through 2D, the same illustrate the structural and functional relationships of the components of the canopy 10, particularly the upper central hub 30, elongate members 66, the spacer and how these components interact with the cable 42 and pulleys 44 during deployment to the deployed position and retraction to the folded position. These figures highlight how the various components direct the movements of the elongate members 66 to traverse the canopy between folded and deployed positions.

FIG. 2 provides a broad perspective of the canopy 10 in its partially deployed state. For example, when the user pulls on the support leg opposite the stationary support leg, the canopy may be deployed to the position shown in FIG. 2. The rest may be completed by the handle. Some of the elongate members 66 are shown forming scissor-like connections 68 (see FIGS. 2 and 3) between the telescoping legs 14. These members are organized into pairs 68 that are pivotally attached to one another and to the telescoping legs 14 via upper corner bracket 28 and a sliding bracket 48 (see FIG. 3B). The canopy 10 is supported by the telescoping legs 14, which include upper legs 16 and lower legs 18 (see FIG. 3).

FIG. 2A zooms in on the upper central hub 30, illustrating its role in coordinating the pivotal connections of the elongate members 66. The upper central hub 30 includes multiple slots 100 (see FIG. 2D) into which the elongate members 66 are pivotally attached. As the canopy transitions between the folded and deployed positions, the upper and lower central hubs 30, 32 move closer to each other or further away from each other.

FIG. 2B focuses on the attachment of the elongate members 66 to the upper central hub 30 and their interactions with the pulleys 44 and cable 42. The figure highlights how the cable 42 is routed over pulley 44 to efficiently transmit force from the handle 26 to the central lower hub 32. The elongate members 66 are shown in pivotal arrangements, which allow them to fold together when the canopy is in its collapsed state and spread apart when the canopy is deployed. The pivotal attachment to the upper central hub 30 of the elongate member 66 housing the cable 42 is achieved through bracket 102 (see FIG. 2D). The pulley 44 is rotationally attached to the bracket 102. The bracket is stationarily attached to the elongate member 66*a*. The bracket 102 is pivotally attached to the slot 100*a*. The cable 42 is rounted over the pulley 44.

FIG. 2C illustrates the detailed assembly of the elongate members 66 at their connections to the upper central hub 30. Each elongate member 66 has end portions that are aligned with the slots 100 (see FIG. 2D) of the upper central hub 30. Pins or fasteners secure the elongate members 66 in place while allowing them to pivot freely. This configuration permits the elongate members 66 to change angles during deployment, facilitating the transition from the folded position to the fully deployed position. The cable 42 is shown routed through the structure to exert force on the central lower hub 32 when the canopy is traversed from the folded position to the deployed position.

FIG. 2D provides a close-up exploded view of the connection between the upper central hub 30 and elongate members 66. The hub 30 features slots 100. One of the slots 100*a* receive bracket 102 connected to the elongate members 66. The bracket 102 includes holes 104 that align with holes 106 in the elongate member 66, allowing them to be secured with pins. Additionally, the pulley 44 is shown rotatably attached to the bracket 102 by aligning hole 108 with holes 110 on the bracket 102. The pulley 44 is positioned within the bracket 102, and this entire assembly is inserted into slot 100*a* of the upper central hub 30. A pin is inserted through the aligned holes of the bracket 102, pulley 44, and slot 100*a*, enabling the assembly to rotate as necessary during folding and deployment.

The cable 42 is routed over the pulley 44 in the upper central hub 30. The cable 42 is then routed downward to the lower central hub 32.

The spacer 34 (see FIG. 2D) is attached to the upper central hub 30 at protrusion 122 to prevent the central upper hub 30 and central lower hub 32 from over-centering or locking up during deployment.

The spacer 34 maintains the proper separation and alignment between the central upper hub 30 and the central lower hub 32 as the canopy is traversed to the deployed position and maintained in the deployed position during use. The spacer 34 is positioned between the central upper hub 30 and the central lower hub 32 to prevent these hubs 30, 32 from over-centering or locking up, ensuring smooth and controlled movement of the canopy back to the folded position when desired and upon release of the handle.

Figure 6A:
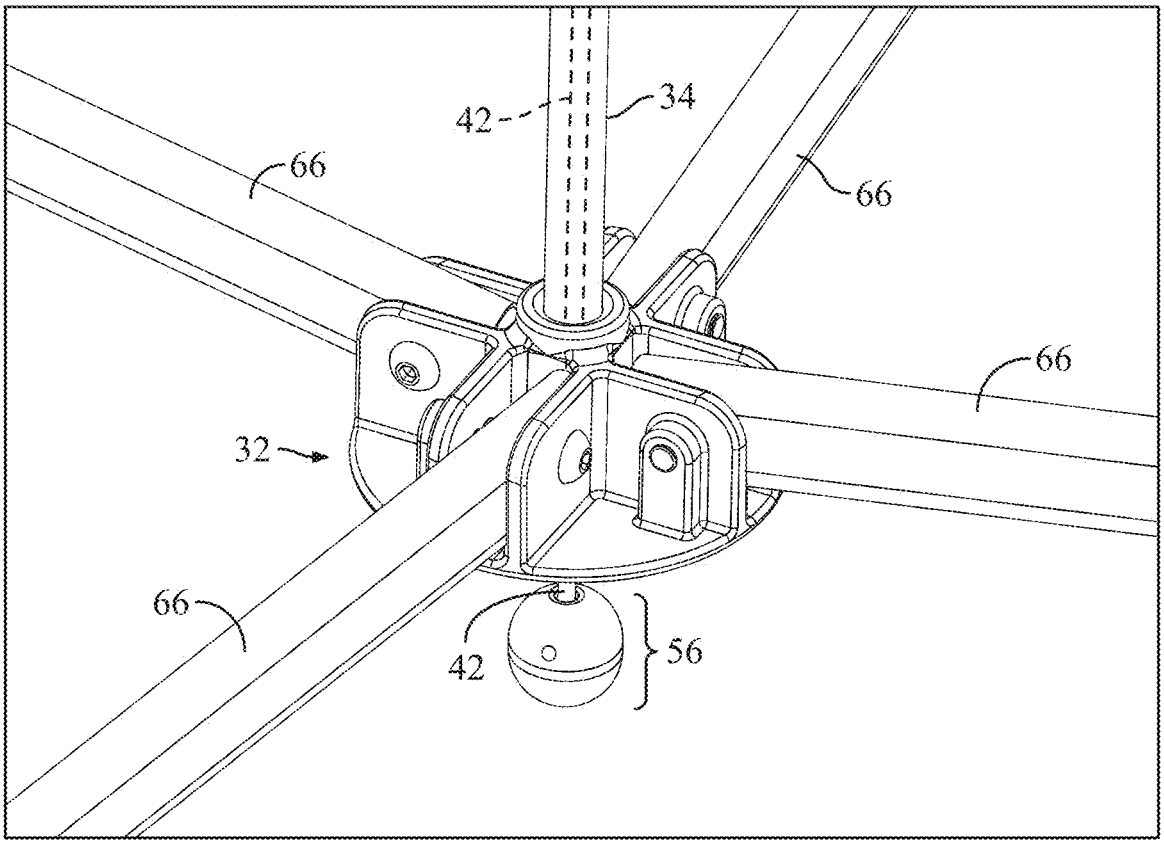
FIG. 6A illustrates a close-up view of the spacer and the central lower hub, showing how the spacer prevents the device from going over center.

The spacer 34 is shown in FIGS. 2D, 6, and 6A and is attached to the central upper hub 30 at protrusion 122 (see FIG. 2D). The protrusion 122 provides a secure mounting point for the spacer 34, ensuring that it remains rigidly connected to the central upper hub 30. The spacer 34 is preferably constructed from a durable material, such as metal or reinforced plastic, to withstand the forces exerted during deployment and use of the canopy. Its length is designed to maintain an optimal distance between the central upper hub 30 and the central lower hub 32 when the canopy 10 is in the deployed position, ensuring prevention of the elongate members from reaching an over center position.

As the canopy transitions from the folded position to the deployed position, the cable 42 exerts tension on the central lower hub 32, drawing it closer to the central upper hub 30. During this process, the spacer 34 acts as a physical barrier to prevent the hubs from moving too close to each other, which could otherwise cause mechanical locking of the connected elongate members 66. By maintaining this separation, the spacer 34 ensures that the elongate members 66 pivot freely so that when the handle is released, the canopy at least partially goes back to the folded position.

In FIG. 6, the spacer 34 is shown when the canopy is in the deployed position, maintaining the separation between the hubs 30, 32. FIG. 6A provides a closer view, highlighting how the spacer 34 interfaces with the lower hub 342 and elongate members 66.

FIGS. 2 through 2D collectively demonstrate the functionality of the canopy's upper central hub 30, lower central hub 32, spacer 34 and elongate members 66. When the user pulls the handle 26, tension in the cable 42 causes the central lower hub 32 to move closer to the central upper hub 30. This movement increases the angle between the elongate members 66 and pushes the telescoping legs 14 outward into their deployed positions. The upper central hub 30 acts as a node in this process, organizing the movement of the elongate members 66 during both deployment and retraction.

Referring now to FIG. 3, the same illustrates the canopy 10 in its fully deployed position. In this state, the canopy 10 provides a fully tensioned cover 12 supported on the telescoping legs 14 and elongate members 66. The elongate members 66 have pivoted outward, increasing the angle 92 (see FIG. 3A) between them to its maximum, as the central upper hub 30 and the central lower hub 32 have been drawn closer together by the tensioned cable 42. This canopy is in its fully deployed position.

The telescoping legs 14 are fully extended, with the lower legs 18 adjusted to the desired height via the middle brackets 38 (see FIG. 7). The stationary foot 20*a*, equipped with a high-friction surface 82 (see FIG. 8C), provides a fixed anchor point for the structure, while the rolling feet 20 on the other legs allow for these feet 20 to roll into position during deployment. The handle 26 is locked into the latch 84 (see FIG. 3C) at the lower portion 72 of the upper leg 16, maintaining tension in the cable 42 and securing the canopy 10 in its deployed position.

FIG. 3A provides a closer view of the upper corner bracket 28 when the canopy 10 is fully deployed. The upper corner bracket 28 connects the upper portion 70 (see FIG. 3B) of the upper leg 16 to the elongate members 66 and houses the pulley 44 for guiding the cable 42. In this position, the elongate members 66 are extended outward, pivoting at their connections to the upper corner bracket 28.

FIG. 3B shows the internal structure of the upper portion 70 of the upper leg 16 with the upper corner bracket 28 removed. This figure provides a view of the attachment points for the upper corner bracket 28 and other components. The cable 42 is shown routed through the internal cavity 168. This internal routing ensures that the cable 42 is guided protected from external forces during use.

Figure 3C:
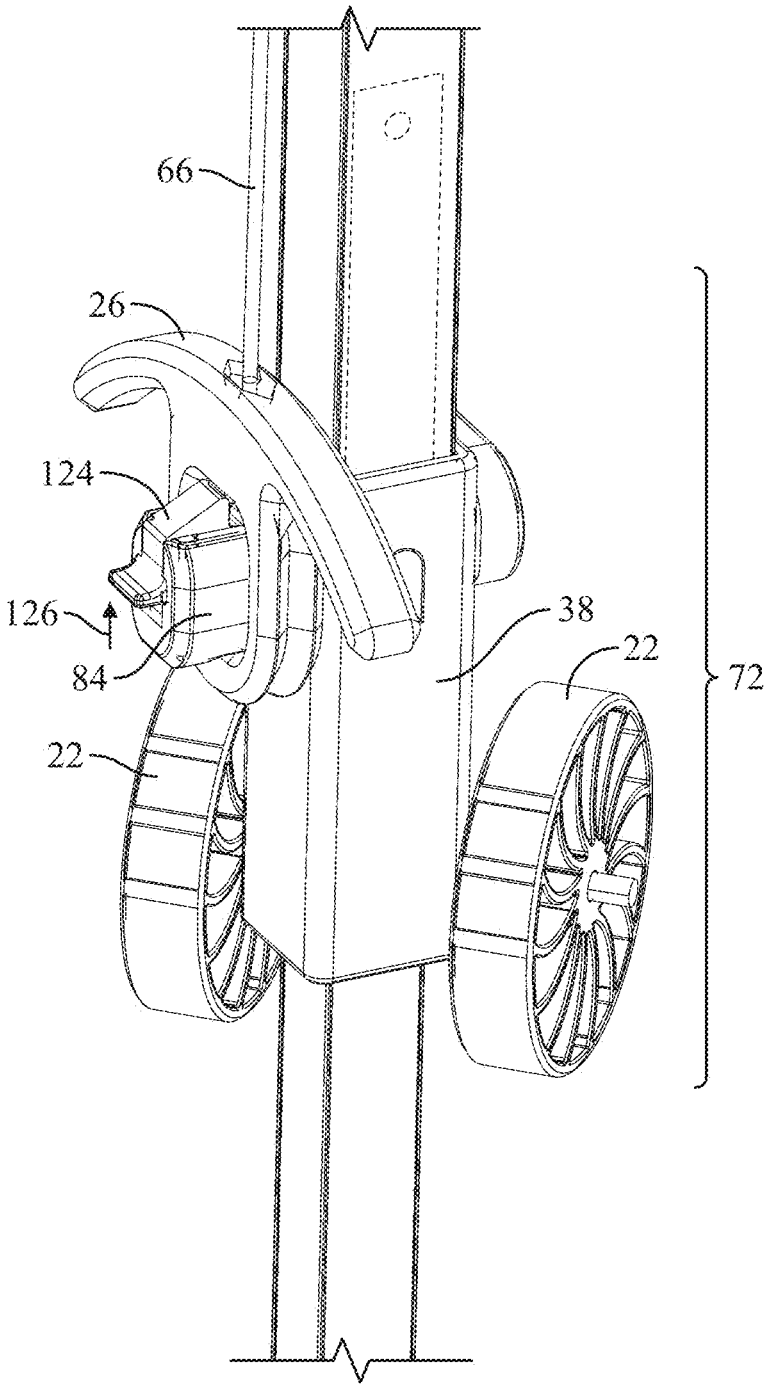
FIG. 3C illustrates the handle locked into the latch on the upper leg to allow for folding of the canopy or attaching to the latch to maintain tension in the cable.
Figure 3D:
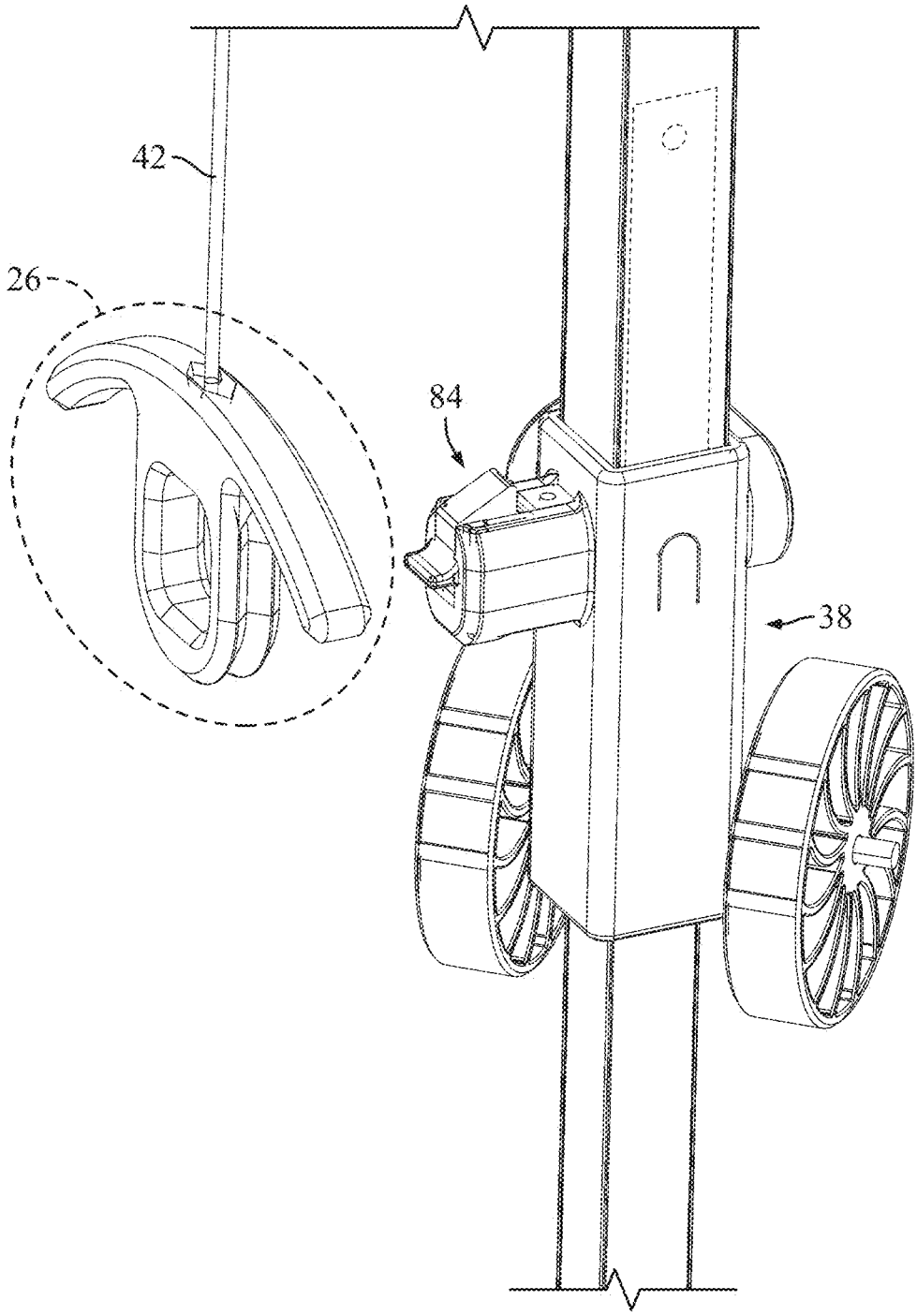
FIG. 3D illustrates the handle being released from the latch, initiating the folding process.

Referring now to FIGS. 3C and 3D, the same shows the handle 26 and its role in the deployment, locking, and retraction of the canopy 10. The handle 26 is positioned adjacent to the lower portion 72 of the upper leg 16 during the deployed position. The handle 26 is connected to the cable 42, which is routed through a series of pulleys 44 to force the central hubs 30 and 32 toward each other to deploy the canopy. This arrangement allows the user to fully deploy the canopy 10 by pulling the handle 26 downward, thereby tensioning the cable 42 and drawing the central lower hub 32 closer to the central upper hub 30 until the canopy is fully deployed. This action causes the elongate members 66 to pivot outward, extending the telescoping legs 14 into their fully deployed position.

Once the canopy 10 is fully deployed, the handle 26 is secured into a latch 84 mounted on the lower portion 72 of the upper leg 16. The latch 84, as shown in FIG. 3C, includes a spring-loaded trigger 124 that automatically locks the latch 84 to the locked configuration, securing the handle 26 in place. This locking mechanism ensures that the tension in the cable 42 is maintained, keeping the central lower hub 32 in closer proximity to the central upper hub 30 and stabilizing the canopy 10 in its deployed position during use by the user. The latch 84 is designed to withstand the high tension in the cable 42 and external forces acting on the canopy 10, ensuring a reliable and durable locking system.

FIG. 3D illustrates how the handle 26 is released from the latch 84 when the user wishes to retract the canopy 10. To disengage the handle 26, the user presses the spring-loaded trigger 124 upward, as indicated by arrow 126 (See FIG. 3C). This action compresses the spring inside the latch 84, releasing the handle 26 and allowing it to move freely. When released, the handle is allowed to move upward. The tension in the cable 42 decreases, permitting the central lower hub 32 to move away from the central upper hub 30. This movement causes the elongate members 66 to pivot inward, retracting the support legs 14 and folding the canopy 10 back into its folded configuration.

Figure 4:
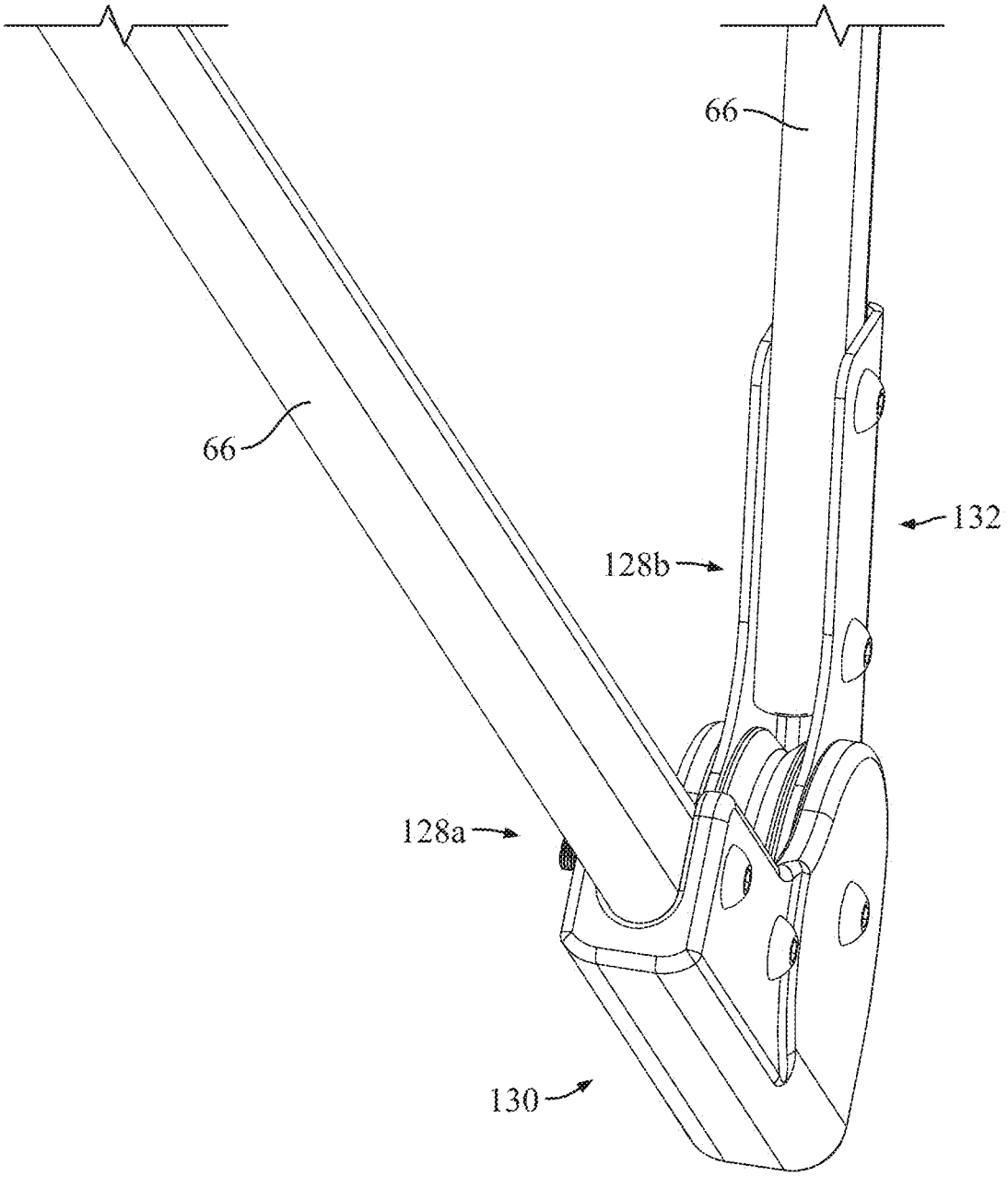
FIG. 4 illustrates the pivotal connections of the elongate members, showing their arrangement as pairs forming a chopstick-like mechanism.
Figure 4A:
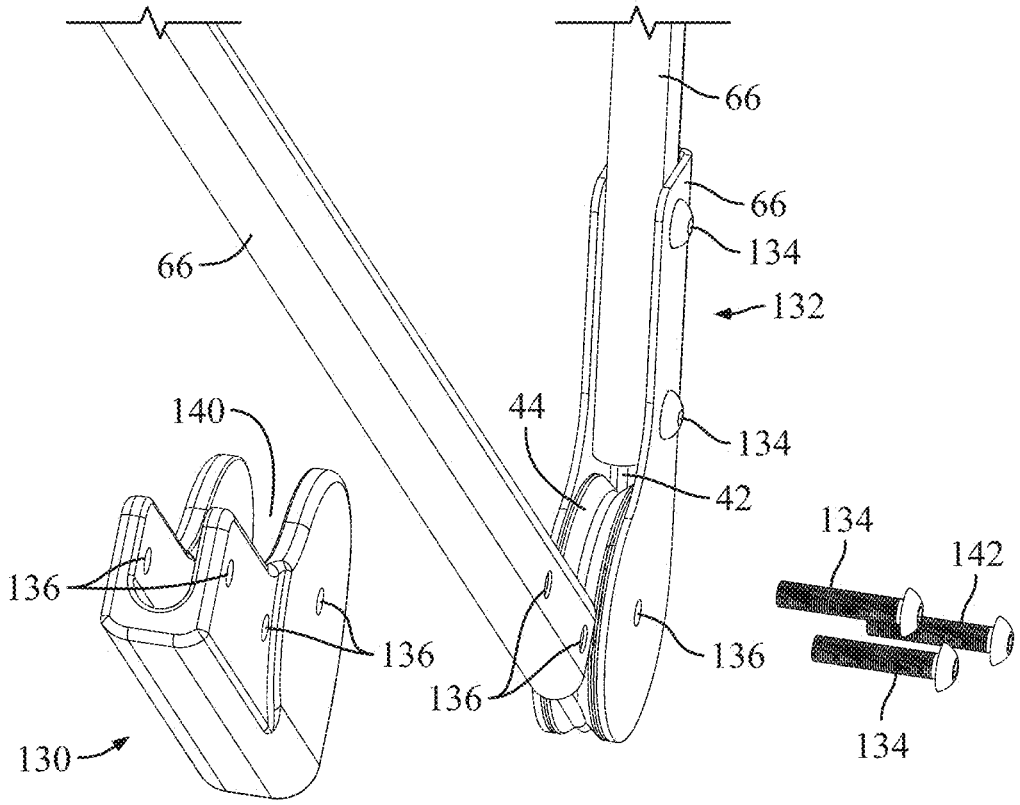
FIG. 4A illustrates an exploded view of the brackets connecting the elongate members, with an integrated pulley for cable routing.
Figure 4B:
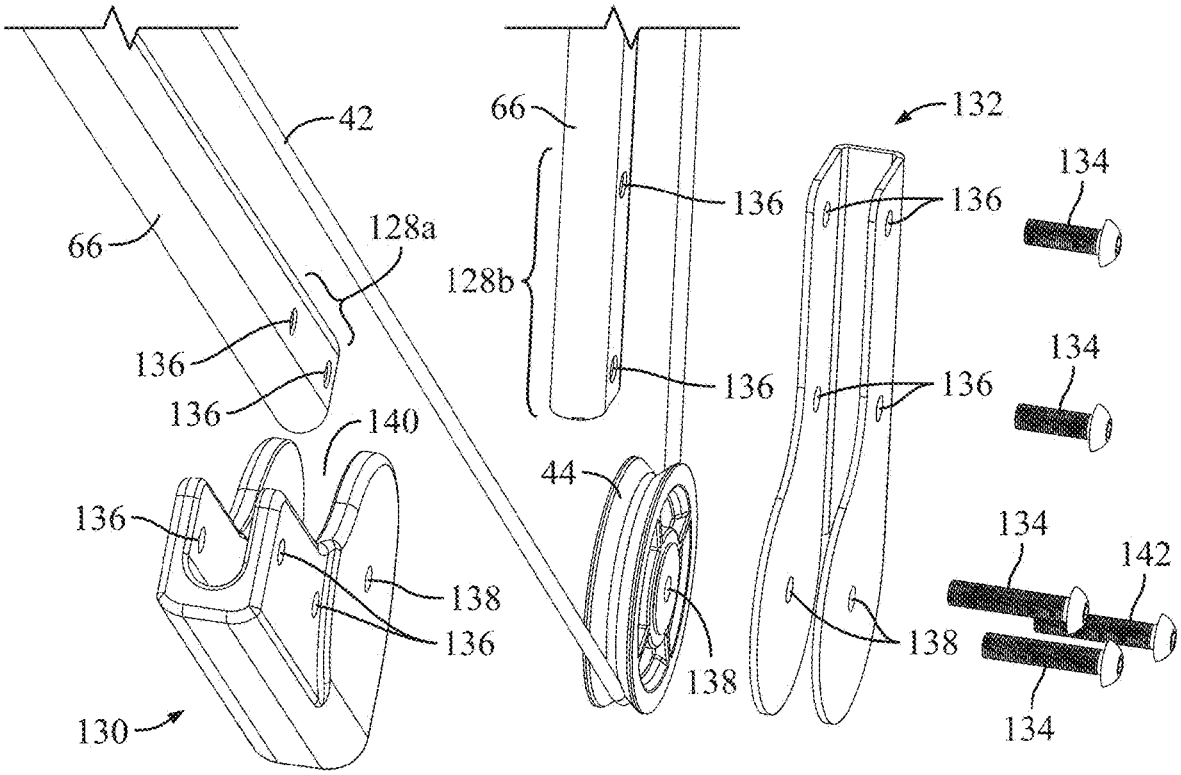
FIG. 4B illustrates a further exploded view of the brackets and pulley assembly, showing the alignment of components.

Referring now to FIGS. 4-4B, a close up of the pivotal connection shown in FIG. 2 is shown. FIGS. 4 through 4B provide detailed views of the pivotal connections between elongate members 66 and the components that facilitate their movement, stability, and force transmission within the canopy 10. These figures illustrate the structural arrangement of the elongate members 66 and how they interact with stabilizing brackets, pulleys, and other features to enable smooth deployment and retraction of the canopy.

Referring now to FIG. 4, the same is a view of the pivotal connections formed between two elongate members 66, namely, a first elongate member 66 and a second elongate member 66, connected at their end portions 128*a, b*. These elongate members 66 are tubular in design to reduce weight while maintaining structural integrity. The elongate members 66 pivot relative to each other, forming a chopstick-like mechanism that expand outward as the canopy 10 is deployed. This pivotal motion enables transitioning the canopy 10 between the folded and deployed positions. The elongate members 66 may be further attached to other elongate members 66 and the telescoping legs 14 via brackets and to the central upper hub 30 and central lower hub 32.

FIG. 4A provides another view of the pivotal connection between two elongate members 66 at their end portions. These end portions are connected via brackets 130 and 132, which are designed to allow free pivoting motion while routing the cable. The brackets 130 and 132 are attached to the elongate members 66 using pins 134, which are inserted through aligned holes 136 in the brackets and the end portions of the elongate members 66. This connection ensures that the elongate members 66 can pivot while remaining securely attached to one another.

The figure also illustrates how a pulley 44 is positioned between the brackets 130 and 132 to guide the cable 42 through the system. The pulley 44 is mounted within the bracket 132 by aligning holes 138 in the pulley and the bracket, and securing it with a pin. The entire assembly, including the pulley 44 and the connected elongate members 66, is inserted into slot 140 of bracket 130. Another pin 142 is inserted through aligned holes in the bracket 130, pulley 44, and bracket 132. This configuration allows the cable 42 to be routed through the pulley 44, ensuring efficient force transmission while enabling the pivotal motion of the elongate members 66.

FIG. 4B provides an exploded view of the connection shown in FIG. 4A, detailing the assembly of the brackets 130 and 132, the pulley 44, and the elongate members 66. The cavity within bracket 132 houses the pulley 44, while the slot 140 in bracket 130 receives the bracket 132 and the pulley 44. The end portions 128*a, b* of the elongate members 66 are inserted into these brackets 130, 132, with their holes aligned to ensure secure attachment via pins 134 and 142. This figure also shows the role of the pulley 44 in routing the cable 42. The cable 42 passes under the pulley 44, which reduces friction and ensures smooth operation as tension is applied.

FIGS. 4 through 4B demonstrate the assembly of the elongate members 66 and their pivotal connections. The brackets 130 and 132, along with the pins and pulleys 44, ensure that the elongate members 66 can pivot freely while remaining securely attached. This pivotal motion allows the canopy 10 to transition smoothly between its folded and deployed positions. Additionally, the integration of the pulley 44 within the brackets facilitates efficient cable routing, reducing manual effort during deployment and retraction of the canopy.

Figure 5:
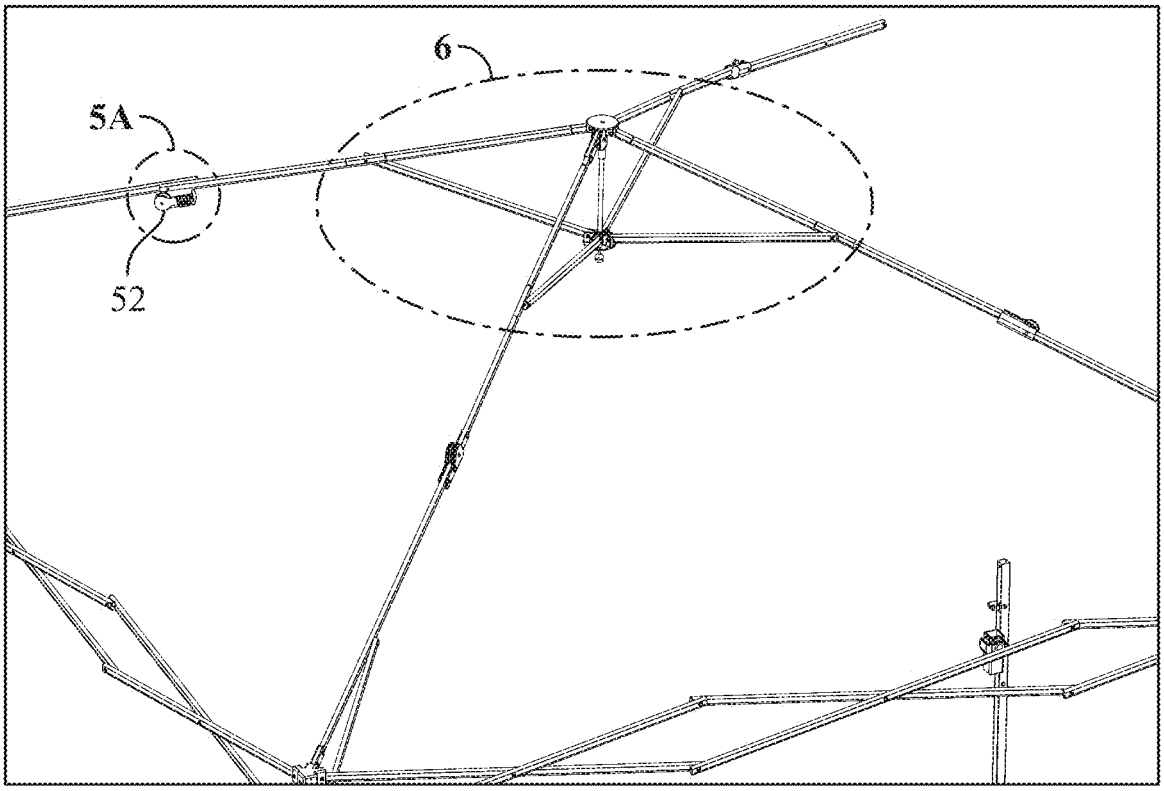
FIG. 5 illustrates the pivoting brackets connecting elongate members and their role in guiding movement during deployment and the upper and lower central hubs during deployment of the canopy.
Figure 5B:
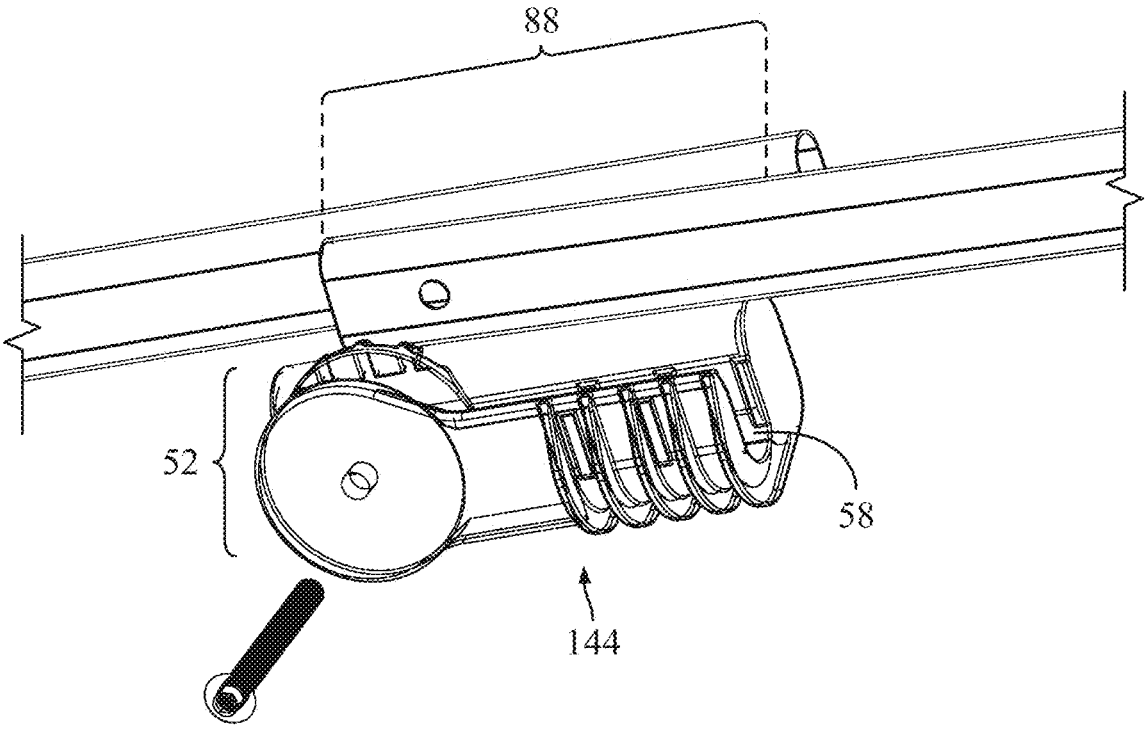
FIG. 5B illustrates the elongate members and pivoting brackets as an exploded view during deployment.
Figure 5C:
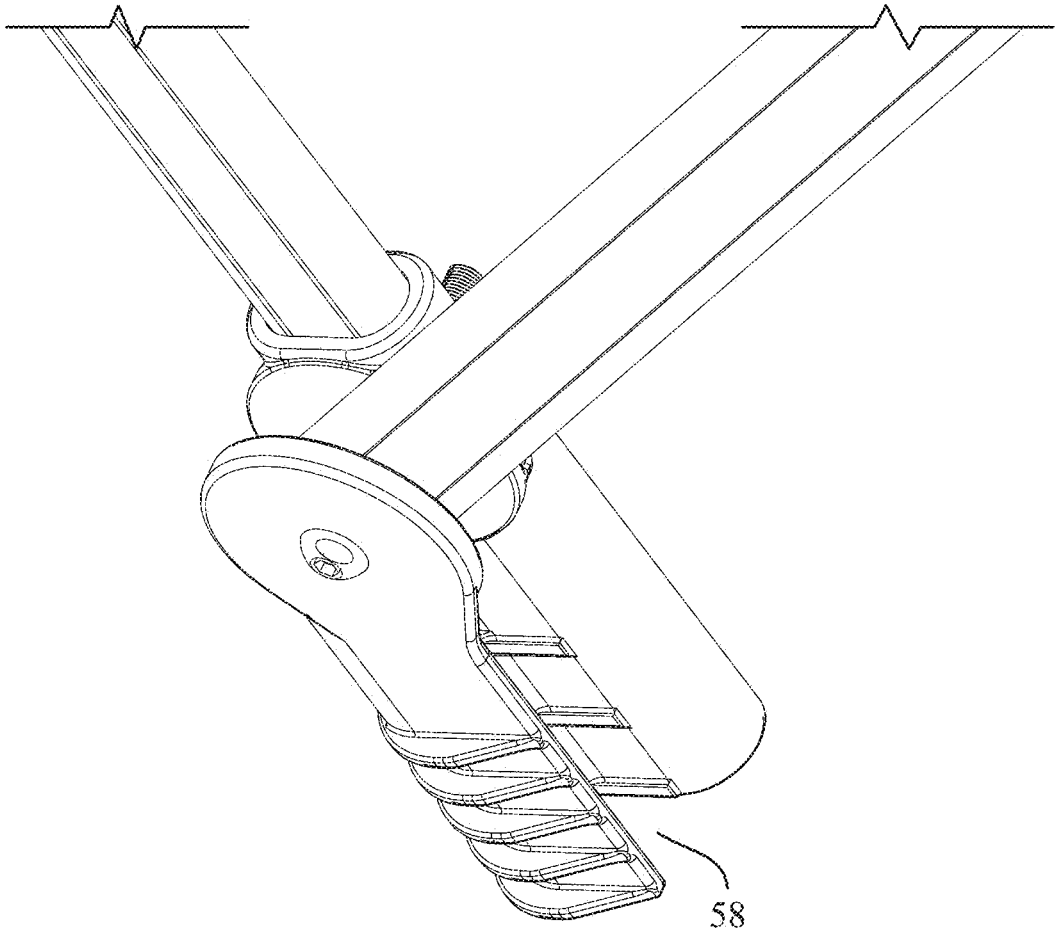
FIG. 5C illustrates the pivoting brackets and elongate members in the collapsed position, with the elongate member disposed outside of the slot.
Figure 5D:
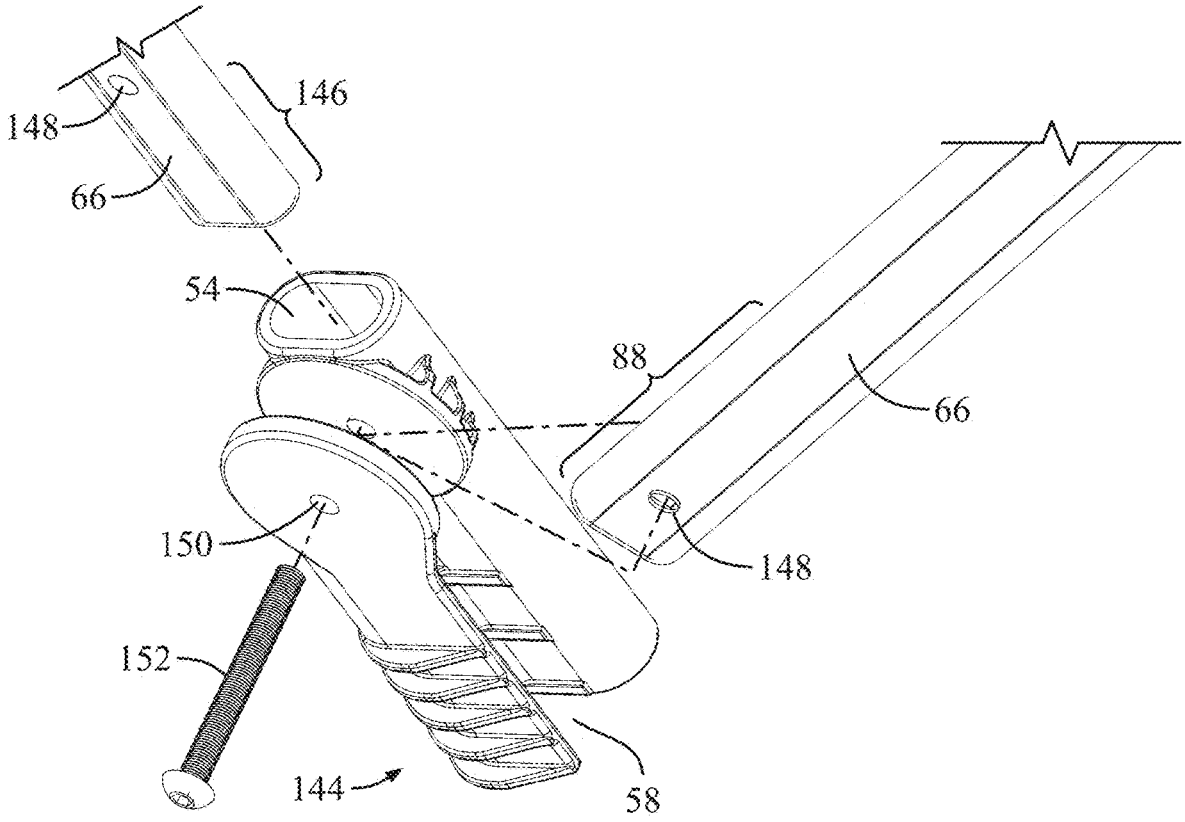
FIG. 5D illustrates an exploded view of the pivoting bracket assembly, showing the alignment and attachment of elongate members.

Referring now to FIGS. 5 through 5D, the same provides detailed views of the connections and pivotal mechanisms between elongate members 66, focusing on how pivoting bracket 52 stabilize and reinforce the structure of the canopy 10. These figures highlight the design features of the pivoting bracket 52, including cavities, slots, and the use of pins to secure the connections, and they demonstrate how these components contribute to the deployment and structural integrity of the canopy.

FIG. 5 offers a broad perspective of the pivotal connections between elongate members 66 using pivoting brackets 52. The elongate members 66 are pivotally connected at their end portions 146 and 148 via the pivoting brackets 52. The elongate members 66 are tubular and lightweight, designed to pivot smoothly during deployment. As the canopy is deployed, the pivoting brackets 52 guide the elongate members 66 to pivot outward. This pivotal motion assists in the canopy's expansion and provides stability.

FIG. 5A provides a closer view of a pivoting bracket 52. Its cavity 54 and slot 58 are shown in FIG. 5D. The cavity 54 and the slot 58 are designed to securely receive the end portions 146 and 88 of the elongate members 66. The cavity 54 houses one end portion 86 of an elongate member 66, providing a stable connection while allowing for pivotal motion. The slot 58 receives another end portion 88 of an adjacent elongate member 66 during deployment. This interlocking design enhances structural stability, particularly in the fully deployed position, as the slot 58 ensures that the elongate members 66 remain securely aligned and resist lateral movement.

The bracket 52 includes holes 150 (see FIG. 5D), which align with corresponding holes 148 in the end portions of the elongate members 66. These aligned holes 148, 150 enable the use of a pin 152 to secure the connection while permitting the necessary pivoting motion. The pin 152 is designed with a threaded end portion, which engages with threads formed on the back side of the pivoting bracket 52, ensuring a secure and robust attachment.

FIG. 5B shows the bracket 52 exploded off of the members 66. The bracket's cavity 54 (see FIG. 5D) and slot 58 (see FIG. 5D) ensure that the elongate members 66 remain securely connected while accommodating the pivoting motion.

FIGS. 5A and 5B shows the pivoting bracket 52 and elongate members 66 in the fully deployed position. At this stage, the end portion 88 (see FIG. 5B) of one elongate member 66 is fully seated within the slot 58 (see FIG. 5A) of the pivoting bracket 52, locking the connection and reinforcing the structure of the canopy 10. This locked configuration prevents unintentional movement of the elongate members 66, providing stability to the canopy in its deployed state.

The figure also emphasizes the robust design of the pivoting bracket 52. The use of high-strength materials and secure pin connections ensures that the bracket can withstand the forces exerted during deployment and use, contributing to the overall durability of the canopy 10.

FIG. 5D provides an exploded view of the pivoting bracket assembly, detailing how the components are aligned and connected. The end portions 146, 88 of the elongate members 66 are inserted into the cavity 54 and slot of the pivoting bracket 52, respectively. The holes 148 in the elongate members 66 align with the holes 150 in the pivoting bracket 52, allowing for the insertion of the pin 152. The left member 66 is fixed stationarily to the bracket 52. The right member 66 shown in FIG. 5D can pivot with respect to the bracket 52. The threaded end of the pin 152 is secured into the bracket 52, ensuring a firm and stable connection.

The pivoting brackets 52 also contribute to the structural integrity of the canopy 10 by evenly distributing the forces exerted during operation. By securely connecting the elongate members 66 and guiding their pivotal motion, the brackets enable the canopy 10 to transition efficiently between positions while maintaining stability and durability. These figures underscore the importance of the pivoting brackets 52 in the overall design and functionality of the canopy 10.

FIGS. 6 and 6A focus on the interaction between the central upper hub 30, central lower hub 32, and spacer 34, as well as the routing and termination of the cable 42. These figures highlight the structural and functional details of the central hubs that coordinate the deployment and retraction of the canopy 10. The spacer 34 plays a critical role in maintaining the proper distance between the hubs and preventing over-centering during deployment.

FIG. 6 provides an overall view of the central upper hub 30, central lower hub 32, and the spacer 34 that separates them. The central upper hub 30 is positioned at the apex of the canopy 10 and serves as the attachment point for the first elongate members 66. These elongate members 66 are pivotably connected to the slots 100 in the central upper hub 30. The central lower hub 32 is connected to the second elongate members 66 and is initially separated from the central upper hub 30 when the canopy 10 is in the folded position.

The spacer 34 is mounted to the protrusion 122 of the central upper hub 30. It maintains a precise distance between the upper hub 30 and the lower hub 32 as the canopy 10 transitions to the deployed position. By preventing the hubs from moving too close together, the spacer 34 eliminates the risk of over-centering, where the elongate members 66 could lock into a misaligned configuration, obstructing further movement.

Additionally, FIG. 6 illustrates the cable 42 routed through the central hubs 30, 32. The cable 42 passes through a central aperture in the spacer 34 and is attached to the central lower hub 32. The ball 56 is affixed to the cable 42 near its termination at the lower hub 32. As the handle 26 is pulled, the ball 56 presses against the lower hub 32, exerting an upward force that draws the lower hub 32 closer to the upper hub 30. This movement causes the canopy 10 to expand outward into the deployed position.

FIG. 6A provides a closer view of the spacer 34 and its interaction with the central lower hub 32 and cable 42. The spacer 34 is securely attached to the protrusion 122 of the central upper hub 30. The spacer 34 includes a central cavity or aperture through which the cable 42 is routed.

The central lower hub 32 is shown in detail, with the cable 42 terminating at the ball 56. The ball 56, attached to the cable 42, is positioned to press against the lower hub 32 when the handle 26 is pulled. This configuration ensures that the force applied to the handle 26 is directly transmitted to the lower hub 32, moving it upward toward the upper hub 30. This movement drives the elongate members 66 outward, extending the support legs 14 and transitioning the canopy 10 into the deployed position.

FIG. 6A also shows the spacer 34. By maintaining a fixed separation between the upper and lower hubs 30, 32, the spacer 34 prevents misalignment or excessive movement that could compromise the canopy's operation. The spacer also protects the cable 42 from destruction by guiding it through the central aperture of the spacer 34, ensuring that nothing from the outside cuts the cable 42 during deployment and retraction.

FIGS. 6 and 6A highlight the functionality of the spacer 34 and its integration with the central hubs 30 and 32. The spacer ensures proper alignment and separation of the hubs, enabling smooth pivoting of the elongate members 66 and preventing over-centering. This design feature helps to maintain the structural integrity and operational reliability of the canopy 10.

The routing of the cable 42 through the central aperture of the spacer 34 and its termination at the lower hub 32 assists with efficient force transmission. The ball 56 adds a mechanical advantage by concentrating the applied force on the lower hub 32, facilitating the movement of the hubs and elongate members. The central hubs, spacer, and cable work in concert to enable the canopy's smooth transition between folded and deployed positions.

FIGS. 7 and 7A provide detailed views of the middle bracket 38 and its integration with the telescoping legs 14, comprising the upper leg 16 and lower leg 18. These figures illustrate the mechanisms that enable height adjustment of the canopy 10 and demonstrate how the middle bracket 38 securely connects the upper and lower legs while allowing controlled telescoping motion.

FIG. 7 shows the middle bracket 38 attached to the telescoping legs 14. The middle bracket 38 is positioned on the upper leg 16 and acts as a structural bridge between the upper leg 16 and the lower leg 18. The middle bracket 38 is configured to adjustably secure the lower leg 18 within the upper leg 16, allowing the height of the canopy 10 to be tailored to user requirements.

The upper leg 16 includes a hole 154, while the lower leg 18 features multiple holes 156 spaced along its length, as shown in FIG. 7A. The middle bracket 38 includes a spring-loaded trigger 158 with an integrated pin (not shown) that is biased into an engaged position. The pin passes through one of the holes 154 in the upper leg 16 and one of the holes 156 in the lower leg 18, locking the two legs at a fixed relative position. The alignment of the holes allows for precise incremental adjustments of the canopy's height.

To adjust the telescoping legs 14, the user depresses the trigger 158, retracting the pin from the holes 154 and 156. This disengages the locking mechanism, allowing the lower leg 18 to slide freely within the upper leg 16. Once the desired height is reached, the user releases the trigger 158, and the spring bias causes the pin to re-engage with the nearest aligned holes, securing the telescoping legs 14 in the new position.

FIG. 7A provides an exploded view of the middle bracket 38 and its internal components. The figure shows the spring-loaded mechanism within the trigger 158 that biases the pin into its locking position. The trigger 158 is ergonomically designed to be easily operable, allowing the user to adjust the height of the canopy 10 without requiring additional tools.

The figure also highlights the secure attachment of the middle bracket 38 to the lower portion 72 of the upper leg 16. This attachment ensures that the middle bracket 38 remains fixed in position while allowing the lower leg 18 to slide in and out for height adjustments. The design of the middle bracket 38 provides stability to the telescoping legs 14, ensuring that the canopy 10 remains secure at the selected height.

Figure 8:
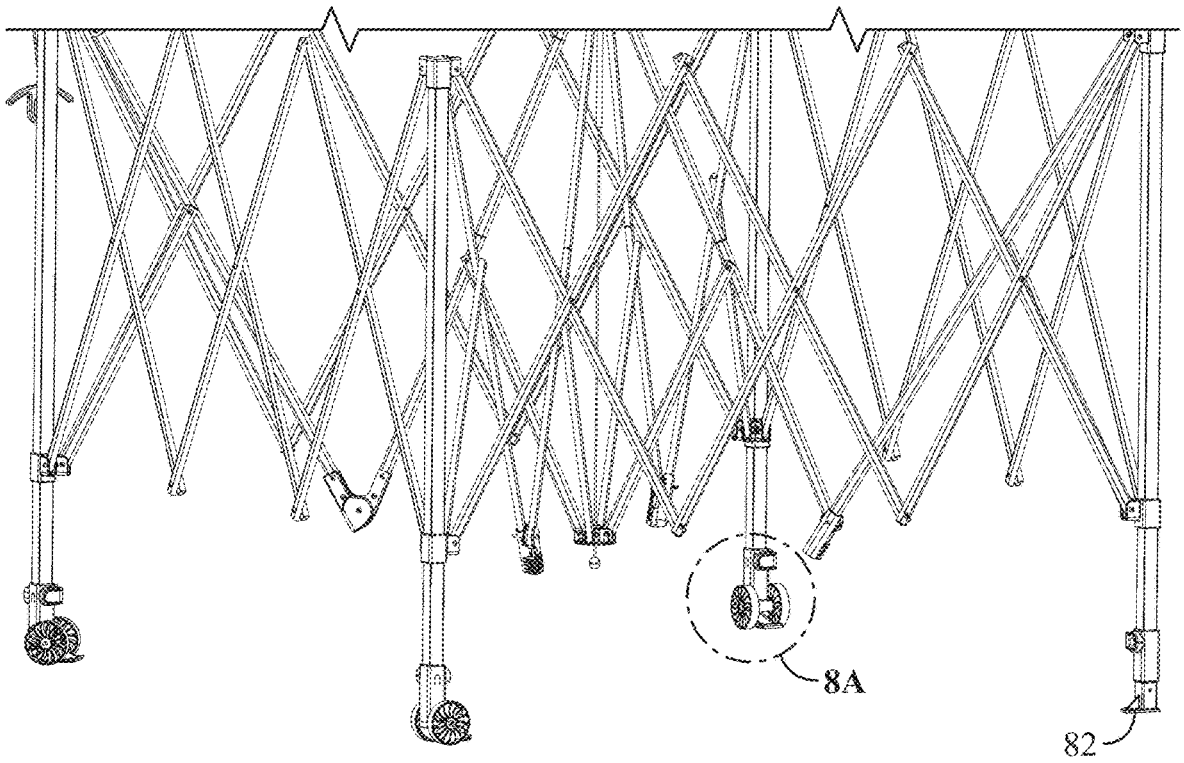
FIG. 8 illustrates the lower portion of the support legs, showing the feet and wheels used for stability and mobility.

The stationary leg 14 is shown in FIGS. 7 and 7A. The middle bracket 38 mounted to the legs 14 that move have wheels 22 and feet 74 as shown in FIGS. 8-8B. For example, brackets 36 (see FIG. 8B) for wheels 22 may be integrated into the middle bracket 38 for legs equipped with rolling feet 20. This dual functionality allows the middle bracket 38 to serve as both a height adjustment mechanism and a mounting point for mobility-enhancing features.

Figure 8A:
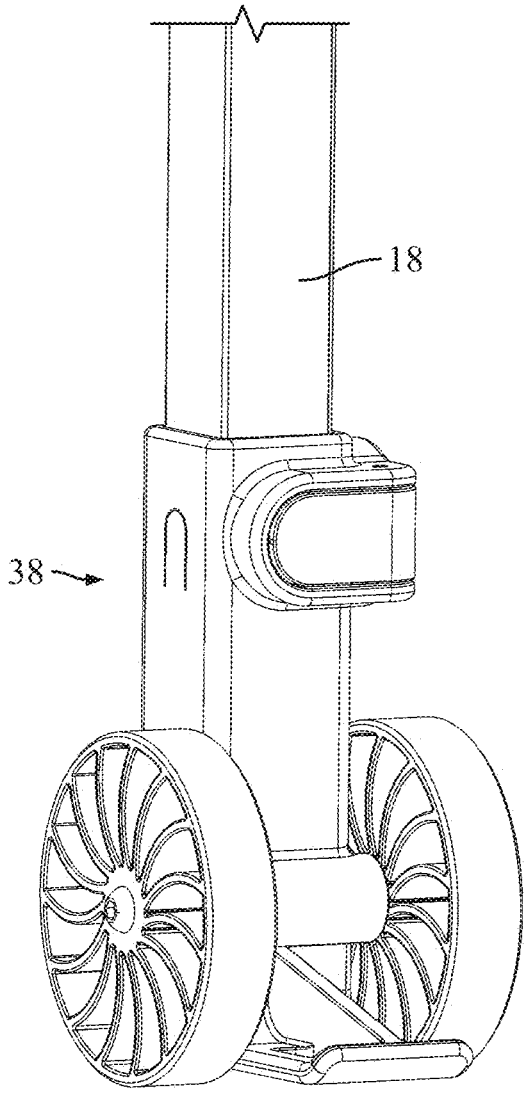
FIG. 8A illustrates the attachment of the wheels to the brackets on the upper leg, highlighting their rotational mounting.
Figure 8B:
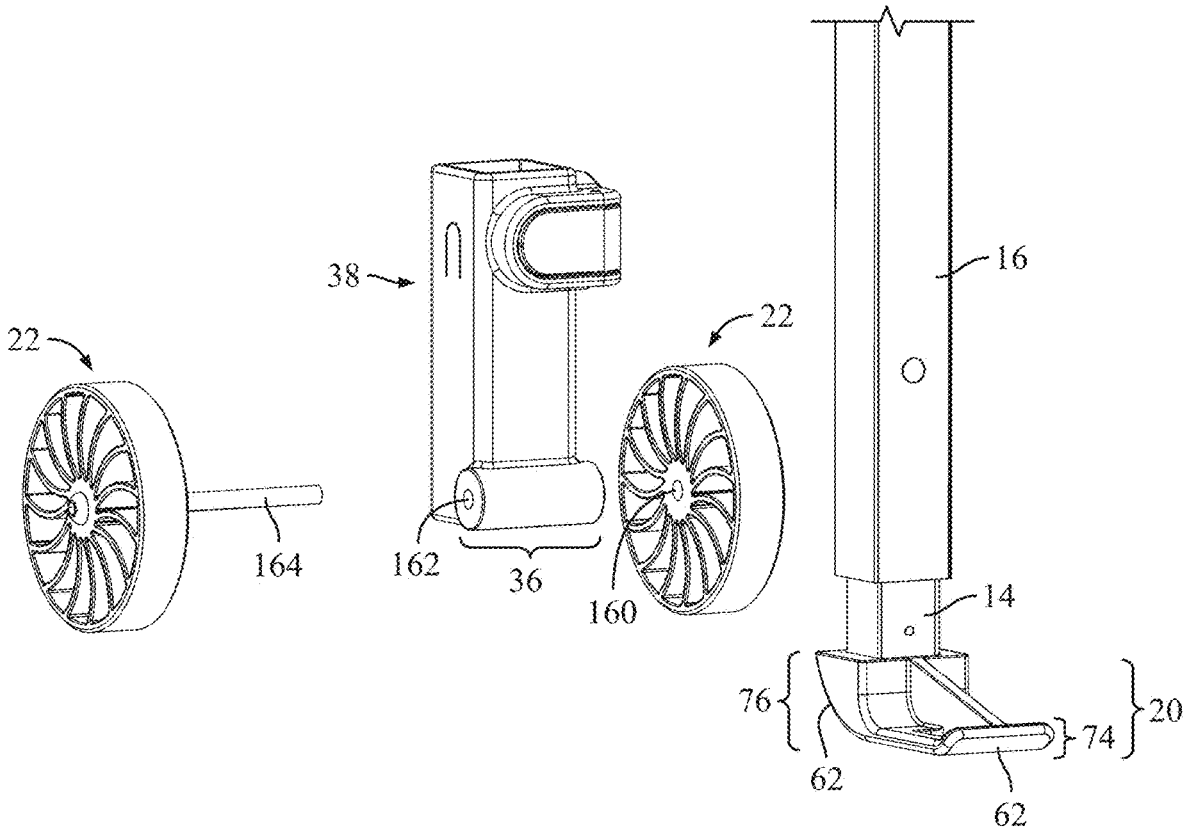
FIG. 8B illustrates the design of the sliding feet, showing their curved portions for navigating uneven terrain.
Figure 8C:
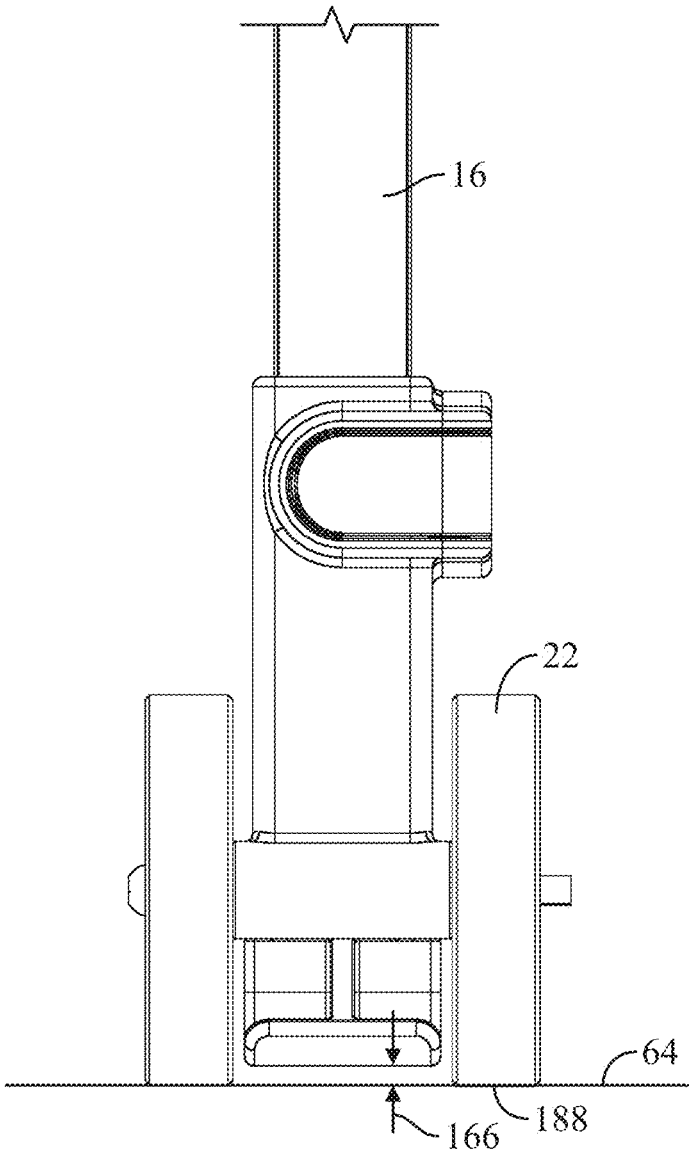
FIG. 8C illustrates the feet and wheels when the lower leg is fully retracted, highlighting the clearance between the foot and ground.

FIGS. 8 through 8C provide detailed views of the feet 20 and wheels 22 attached to the middle bracket 38 for support legs 14 of the canopy 10 that move during deployment and folding. These figures illustrate how the feet 20 interact with the surface 64 (see FIG. 8C) during deployment and retraction and demonstrate how the wheels 22 facilitate mobility, even over uneven terrain.

FIG. 8 shows the lower portion of the support legs 14, including the feet 20 and wheels 22. Three of the support legs 14 has wheels and one of them does not. The one with the wheels move during deployment and folding. The one with no wheel is design to remain stationary during deployment and folding. The feet 20 are attached to the bottom of the lower leg 18, while the wheels 22 are mounted near the lower portion 72 of the upper leg 16.

The feet 20 are designed with a front portion 74 and a rear portion 76, both featuring upward curvatures 62 (see FIG. 8B). These curved portions enable the feet 20 to slide over obstacles such as rocks, grass, or uneven ground during movement. This design reduces resistance and prevents the feet from snagging, ensuring smooth deployment and retraction of the canopy 10.

Three of the support legs 14 are equipped with sliding feet 20 that facilitate movement, while one leg features a stationary foot 20 with a high-friction surface 82 (see FIG. 8) on its underside. This stationary foot serves as an anchor point, resisting sliding during deployment and folding.

FIG. 8A provides a view of the wheels 22 and their mounting to the lower portion 72 of the upper leg 16. The wheels 22 are rotatably attached to brackets 36 (see FIG. 8B), which are fixedly attached to the middle bracket 38. The brackets 36 include apertures 162, which align with corresponding apertures 160 in the wheels 22. Pins 164 are inserted through these aligned apertures, allowing the wheels 22 to rotate freely.

The placement of the wheels 22 ensures that they remain in contact with the surface 64 when the lower leg 18 is fully retracted into the upper leg 16. This configuration allows the canopy 10 to be rolled easily during deployment and folding of the canopy. The wheels 22 are constructed from durable materials to withstand the rigors of outdoor use and ensure smooth movement over various terrain types.

FIG. 8B shows the feet 20. The front portion 74 and rear portion 76 of the foot 20 are shown with upward curvatures 62. These curved sections are critical for enabling the feet 20 to slide over uneven terrain, reducing the risk of getting stuck or obstructed during deployment and folding. The curvature 62 is particularly beneficial when the canopy 10 is being rolled on its wheels 22, as the feet 20 are designed to glide over obstacles rather than snag on the ground.

The foot 20 is attached to the lower end of the lower leg 18 and remains in contact with the surface 64 during deployment. For the stationary foot 20, additional features such as spikes or a high-friction surface 82 enhance grip and stability on soft or slippery surfaces. The sliding feet 20 on the other legs allow for smooth movement, complementing the rolling action provided by the wheels 22.

FIG. 8C illustrates the configuration of the feet 20 and wheels 22 when the lower leg 18 is fully retracted into the upper leg 16. In this position, the lower surface of the foot 20 is positioned higher than the bottom contact patch 188 of the wheels 22 with the surface 64. The distance 166 between the bottom surface of the foot 20 and the contact patch 188 ensures that the wheels 22 make contact with the ground, allowing the canopy 10 to be rolled without interference from the feet 20. If something (e.g., rock) does contact the feet, the upward curvatures 62 cause the feet 20 to slide over the uneven terrain.

Deploying the canopy 10 from its fully folded position to the fully deployed position begins with the user positioning the structure on a flat surface 64. The surface 64 can be a soccer field, grassy area or concrete slab. The user identifies the stationary foot 20, which features a high-friction surface 82 and optional spikes to provide a secure anchor point during deployment. This stationary foot 20 ensures stability, preventing the stationary support leg from sliding as the deployment process begins. The user ensures the support legs 14 are correctly aligned, with the stationary foot 20 fixed firmly on the surface. At this stage, the sliding feet 20 on the other legs are slightly raised off the surface and the wheel contact the ground 64.

To initiate deployment, the user grasps the support leg 14 opposite the stationary foot 20 and pulls it backward along a line 78 (see FIG. 3). As this leg moves, the remaining two legs on either side spread outward along lines 80. The wheels 22 attached to these legs facilitate smooth rolling across the surface 64, even over uneven terrain, while the sliding feet 20 glide over obstacles due to their curved portions 74 and 76. The stationary foot 20*a* remains fixed in place, stabilizing the structure and enabling the user to continue pulling the opposite leg outward. During this process, the central lower hub 32 begins moving slightly upward toward the central upper hub 30, which causes the elongate members 66 to pivot outward.

As the user continues pulling, the elongate members 66 further increase their angle 90 relative to each other toward angle 92. This scissor-like motion of the elongate members 66 pushes the telescoping legs 14 outward. The stabilizing brackets 52 at the pivot points of the elongate members 66 guide their movement. The central hubs 30 and 32 are separated by the spacer 34, which maintains the correct distance between them and prevents over-centering during deployment. At this stage, the canopy structure expands, and the user reaches the point where pulling the legs manually becomes less effective due to the weight of the canopy wanting to stay in this middle position between fully deployed and fully folded.

To complete the deployment, the user detaches the handle 26 from the upper portion 70 of the upper leg 16. The user pulls the handle 26 downward, applying tension to the cable 42, which is routed through a series of pulleys 44 on the upper corner brackets 28 and central hubs 30 and 32. The tension in the cable 42 draws the central lower hub 32 closer to the central upper hub 30. This movement causes the elongate members 66 to pivot further outward, increasing the angle 90 to its maximum angle 92.

Once the canopy is fully deployed, the user secures the handle 26 into the latch 84 located on the lower portion 72 of the upper leg 16. The latch 84, equipped with a spring-loaded trigger 124, locks the handle 26 in place, maintaining tension in the cable 42 and stabilizing the structure. At this point, the elongate members 66 are locked into position by the stabilizing brackets 52, the support legs 14 are fully extended and locked, and the cover 12 is taut.

The support legs 14 can be traversed to their deployed positions. The telescoping legs 14 can be adjusted to the desired height by engaging the middle brackets 38, which lock the lower legs 18 into place via their spring-loaded trigger mechanisms 158. The canopy 10 is now in its fully deployed position, ready for use to provide shade and shelter.

Folding the canopy 10 from its fully deployed position begins with the user collapsing the support legs 14 so that the wheels 22 touch the ground 62. The user now releases the handle 26 from the latch 84 on the lower portion 72 of the upper leg 16. The latch 84, equipped with a spring-loaded trigger 124, may be depressed to disengage the handle 26, allowing it to move freely. As the handle 26 is released, the tension in the cable 42 is reduced, which allows the central lower hub 32 to begin moving away from the central upper hub 30. This movement causes the elongate members 66 to pivot inward, decreasing the angle 92 between the connected elongate members toward angle 90 and initiating the folding process.

The user then moves to the support leg 14 opposite the stationary foot 20 and pushes it forward along line 78 toward the stationary foot 20. The other two support legs, located laterally, also move inward along lines 80 due to the action of the elongate members 66. The wheels 22 on these legs enable smooth rolling across the surface 64, and the sliding feet 20 glide over any obstacles, assisted by their curved portions 62. During this stage, the elongate members 66 pivot closer together. The central hubs 30 and 32 separate further throughout the folding process.

Finally, the canopy 10 can be placed in a storage bag to protect it from dust and damage. In the folded configuration, the compact arrangement of the telescoping legs 14, elongate members 66, and central hubs 30 and 32 minimizes the overall size of the canopy, making it convenient to transport and store.

Figure 9A:
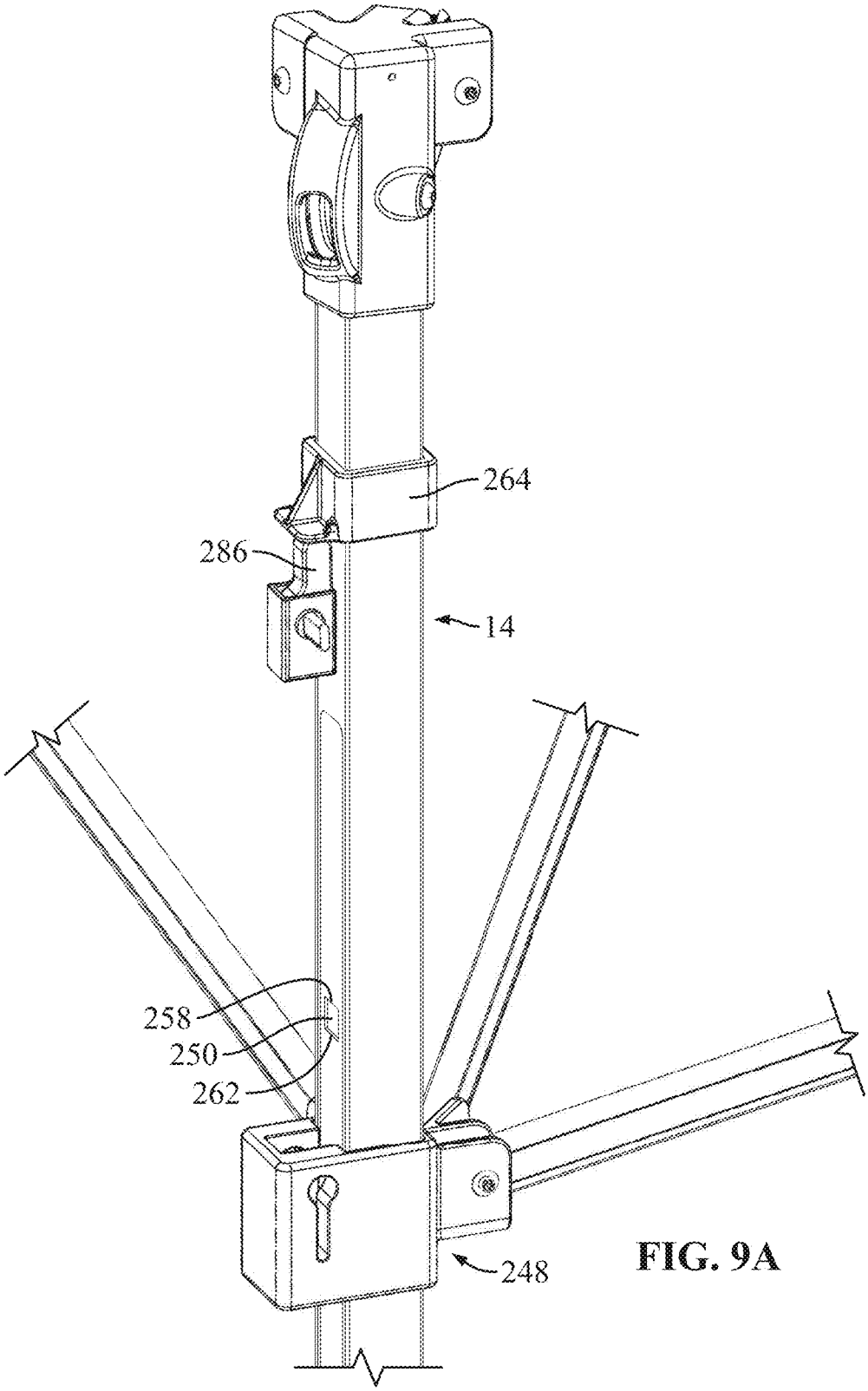
FIG. 9A is an isometric view of the sliding bracket in the deployed position, showing its interaction with the stopping block and placement on the support leg.
Figure 9B:
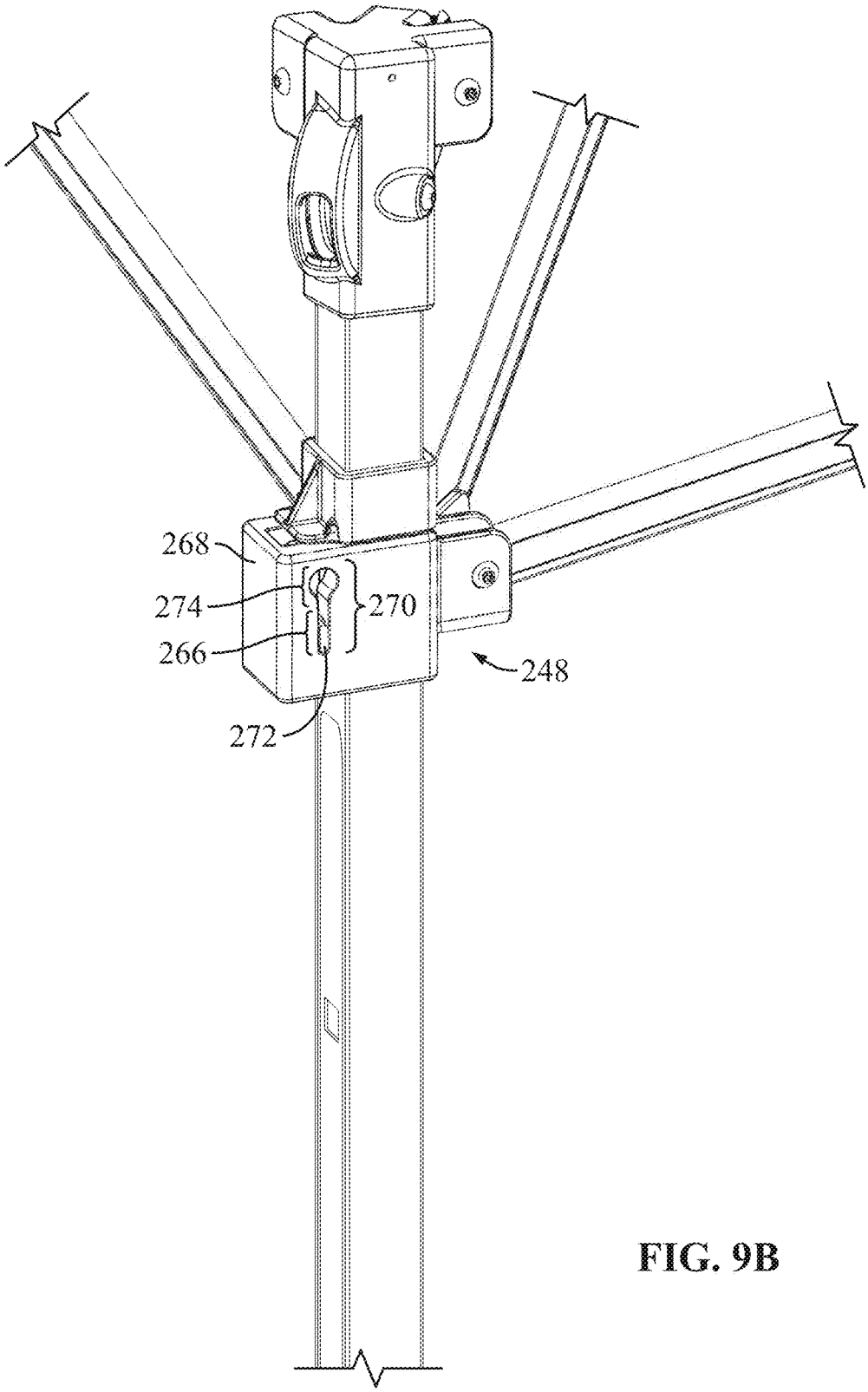
FIG. 9B is a sectional view of the sliding bracket in the first configuration, illustrating its proximity to the notch and movement along the support leg.
Figure 9C:
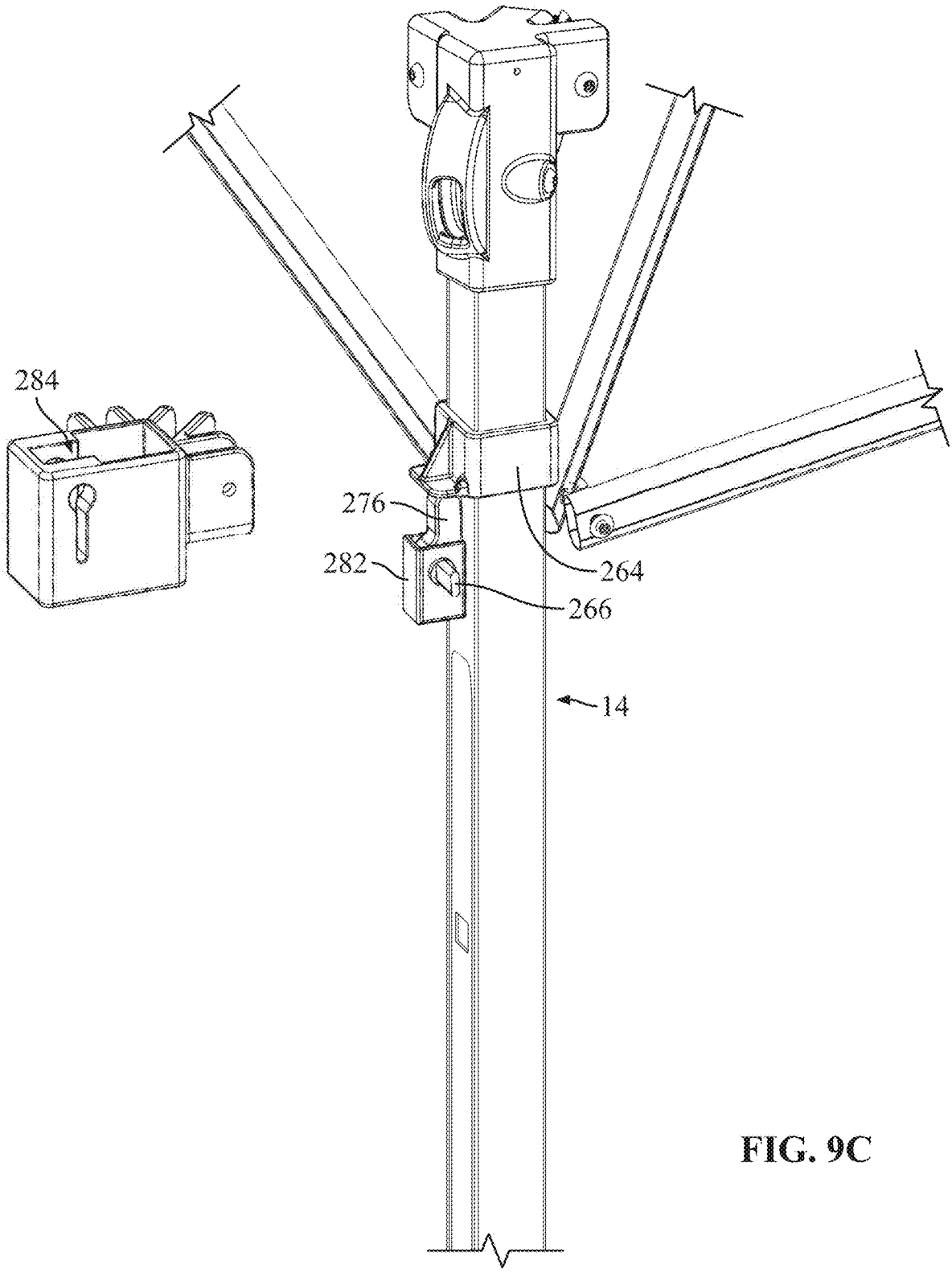
FIG. 9C is a close-up perspective view of the sliding bracket assembly, showing the pin, bolt, and spring components within the U-shaped housing.
Figure 9D:
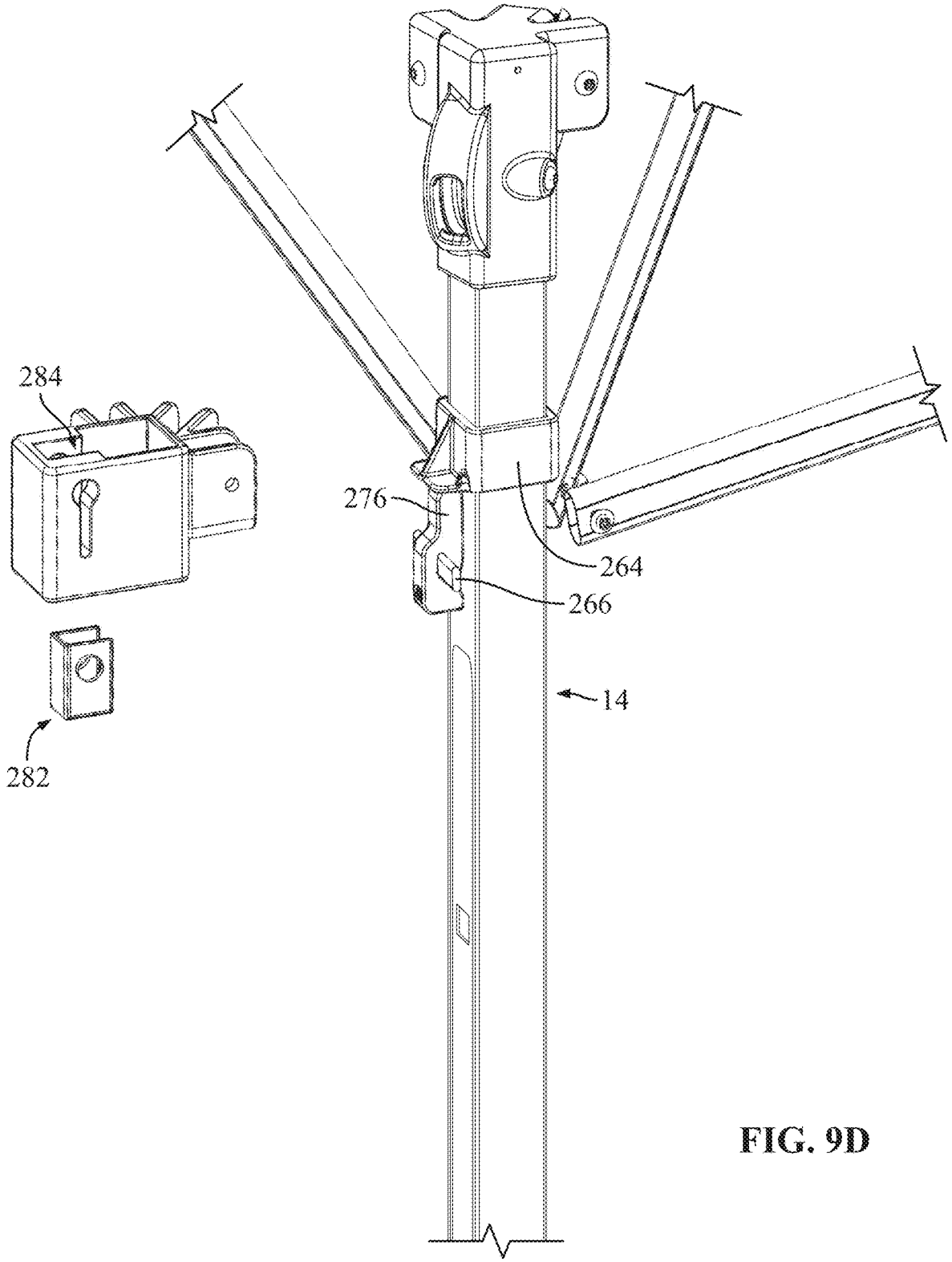
FIG. 9D is the same view as FIG. 9C but with the U shaped bracket removed.
Figure 9E:
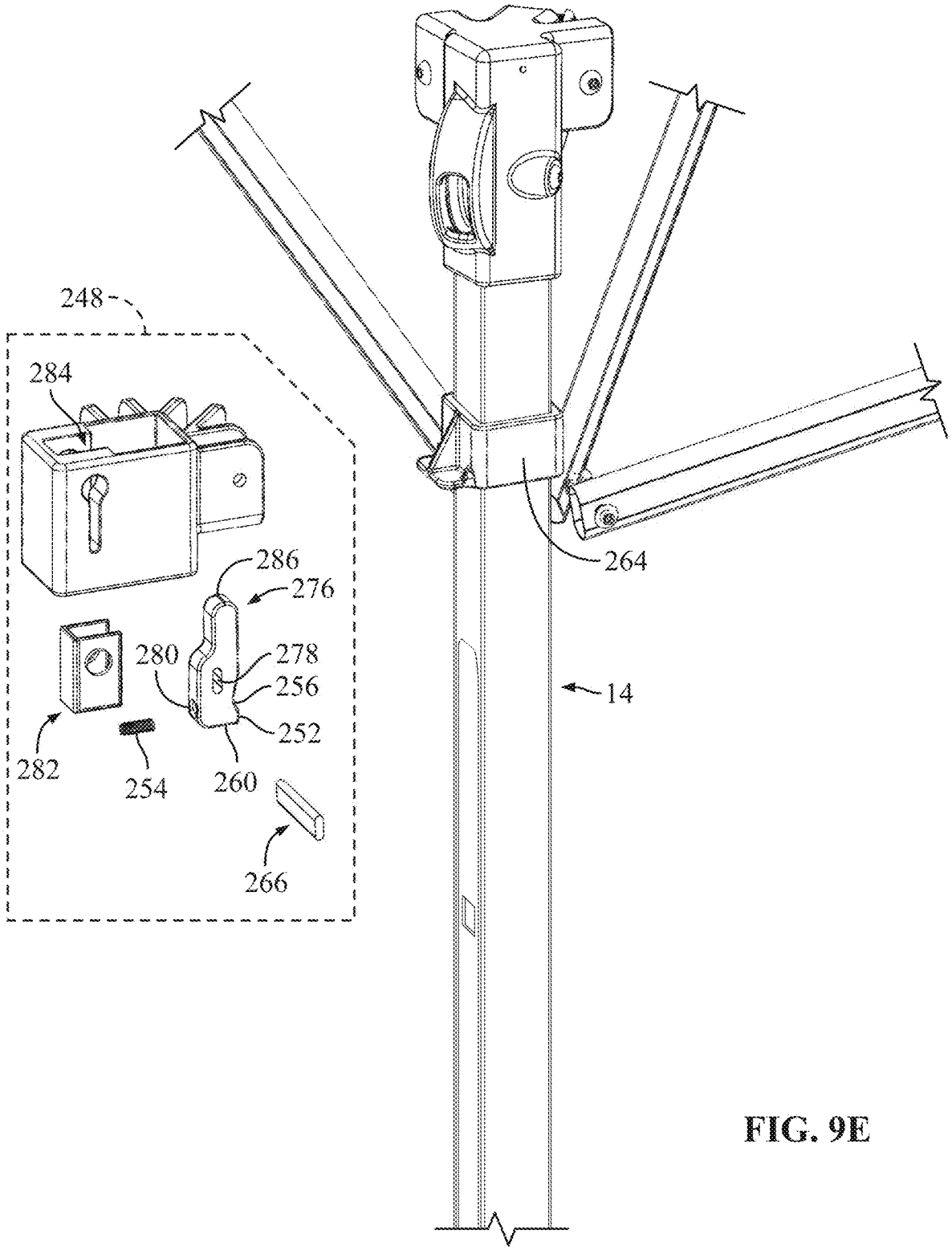
FIG. 9E is an exploded view of the sliding bracket, depicting its internal components, including the pin, bolt, catch, spring, and housing.
Figure 9F:
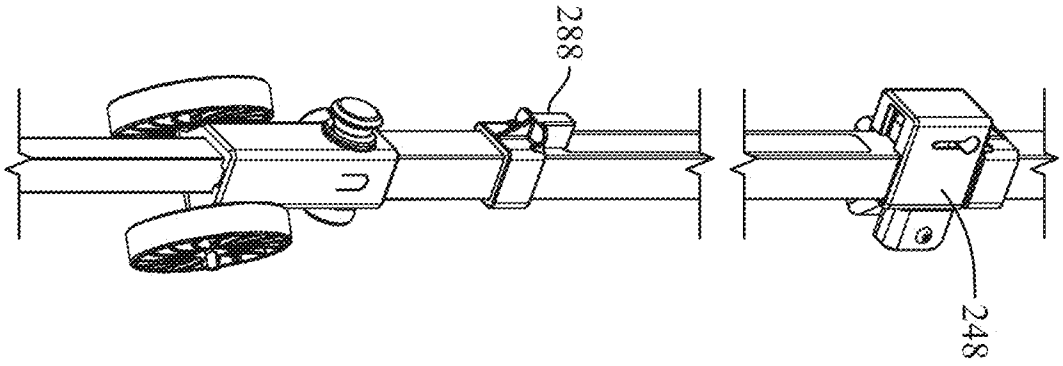
FIG. 9F is a bottom perspective view of the sliding bracket as it approaches the protrusion.

Optionally, the sliding bracket 248, as shown in FIGS. 9-9F, may replace the sliding bracket 48. The sliding bracket 248 facilitates the transition during the process of traversing the canopy 10 from the folded position to the deployed position. Initially, the user pulls on the support leg 14, but at a certain point, they must stop pulling the support leg 14 and begin pulling the handle 26 to complete deployment. The sliding bracket 248 enables a smoother transition for the user at this point in time of traversing the canopy to the deployed position.

In the folded position, the sliding bracket 248 is disposed below a notch 250. The sliding bracket 248 features a catch 252 that is biased toward the support leg 14 by a spring 242. The sliding bracket 248 can freely slide up and down the upper leg 16 of the support leg 14, between the middle bracket 38 and the notch 250, while in its first configuration. When the sliding bracket 248 moves above the notch 250, the catch 252 is pushed outward and received into the notch 250. The catch 252 has an inclined surface 256, allowing it to slide over the upper edge 258 of the notch 250. Once above the notch 250, the sliding bracket 248 cannot move downward because the bottom edge 260 of the catch 252 engages the bottom edge 262 of the notch 250. At this point, the user can release the support leg 14 and grip the handle 26 then pull the handle down to traverse the canopy 10 to the fully deployed then connect the handle 26 to the latch to lock the canopy in the fully deployed position.

During deployment, the sliding bracket 248 initially resides closer to the middle bracket 38 than the notch 250. As the user pulls on the support leg 14, the sliding bracket 248 slides upward, eventually passing above the notch 250. At this point, the user can release the support leg 14, and the canopy remains stable due to the catch 252 engaging the notch 250. The user then pulls the handle 26 to tension the cable 42 and secures the handle 26 to the latch 84. When the canopy is fully deployed, the sliding bracket 248 hits a stopping block 264, as shown in FIG. 9A. Additionally, the sliding bracket 248 transitions to a second configuration, enabling it to slide back below the notch 250. When it reaches the bottom of its travel, the sliding bracket 248 contacts a protrusion 288, which resets the bracket to its first configuration.

The sliding bracket 248 operates as follows. As shown in FIG. 9B, the sliding bracket 248 includes a pin 266 with a non-round shape, such as an elongated oval. A housing 268 of the sliding bracket 248 features a slot 270, which includes a linear portion 272 and a larger round opening portion 274. In the first configuration, the pin 266 resides within the large round opening portion 274, allowing rotation of the bolt 276. When in the second configuration, the pin 266 is positioned within the linear 272, preventing rotation of the bolt.

The sliding bracket 248 also includes the bolt 276 with an aperture 278, into which the pin 266 is inserted. The pin 266 cannot rotate within the aperture 278, fixing the pin 266 and the bolt 276 to each other. A spring 254, housed within an aperture 280, biases the catch 252 of the bolt 276 toward the support leg 14. The pin 266 and bolt 276 are contained within a U-shaped bracket 282, as shown in FIG. 9C. This assembly slides up and down a slot 284 of the housing of the sliding bracket 248.

When the sliding bracket 248 is in its first configuration, the pin 266 resides in the larger round opening portion 274 of the slot 270, permitting rotation of the pin 266 and bolt 276. The spring 254 biases the catch 252 toward the support leg 14. As the sliding bracket 248 slides over and above the notch 250, the spring 254 pushes the catch 252 into the notch 250. The sliding bracket 248 can move upward past the notch 250 because of the inclined surface 256 but cannot move downward because the bottom edge 260 of the catch 252 engages the bottom edge 262 of the notch 250.

When the canopy is fully deployed, an upper protrusion 286 of the bolt 276 contacts a stopping block 264, shifting the pin 266 downward and into the linear portion 272 of the slot 270. In this position, the pin 266 and bolt 276 are oriented so that the catch 252 does not contact the support leg 14 and cannot engage the notch 250, regardless of the spring force from the spring 254. The sliding bracket 248 can be slid down the support leg 14 to fold the canopy 10 back to the folded position. When the sliding bracket 248 reaches the bottom of its travel, the protrusion 288 contacts the bottom block 276 and pushes the pin 266 back into the larger round opening portion 274 of the slot 270. At this point, the sliding bracket 248 returns to its first configuration.

Figure 10:
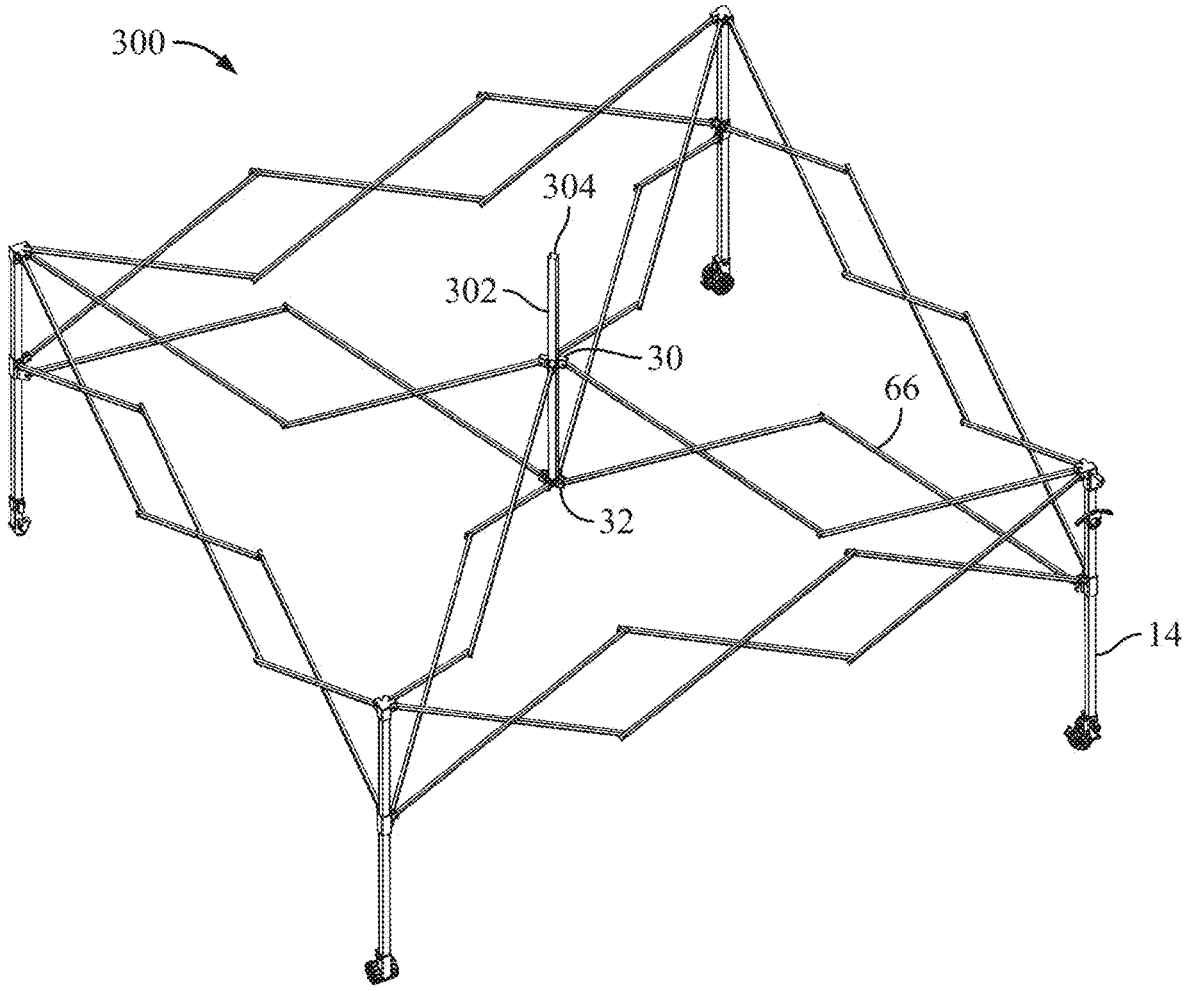
FIG. 10 illustrates an alternate configuration of the central upper and lower hubs.

Referring now to FIG. 10, the same illustrates a frame structure 300 similar to the frame described in FIGS. 1 through 9F. The frame structure may include a central post 302. The central post 302 serves as a stationary vertical support for the canopy frame. In this configuration, the lower hub 32 is attached to the base of the central post 302, while the upper hub 30 is configured to slide up and down the central post 302 as the canopy 10 transitions between the deployed and retracted positions.

In the deployed position shown in FIG. 10, the upper hub 30 has slid downward along the central post 300 to its lowest position. The downward movement of the upper hub 30 is halted by a stopper, such as a pin (not shown) or a spacer (not shown) mounted on the central post 300, which prevents further downward travel. The top of the central post 300 defines a top end 304 that supports the center of the canopy cover 12, ensuring it remains taut and elevated during use. In this configuration, the elongate members 66 pivot outward to extend the support legs 14 fully, providing a stable deployed structure.

When the canopy 10 is retracted, the upper hub 30 slides upward along the central post 302, allowing the elongate members 66 to pivot inward and the telescoping legs 14 to collapse into the folded configuration. This central post 302 arrangement provides additional structural stability and ensures the smooth, guided motion of the upper hub 30 during both deployment and retraction of the canopy 10.

The various aspects described in relation to FIGS. 1 through 9F can be implemented in the frame shown in FIG. 10. For example, the pull handle 26, cable 42, and pulleys 44 can be used to facilitate the movement of the upper hub 30 along the central post 300. The sliding bracket 248 described in FIGS. 9 through 9F can also be incorporated to assist with the smooth transition of the canopy 10 from the folded to the deployed position. Additionally, the features of the telescoping legs 14, such as the middle bracket 38, spring-loaded trigger 158, and wheels 22, can be applied to enhance the functionality of the frame shown in FIG. 10. The stopper, spacer, and top end are new elements specific to this configuration, providing improved support and functionality.

Figure 11:
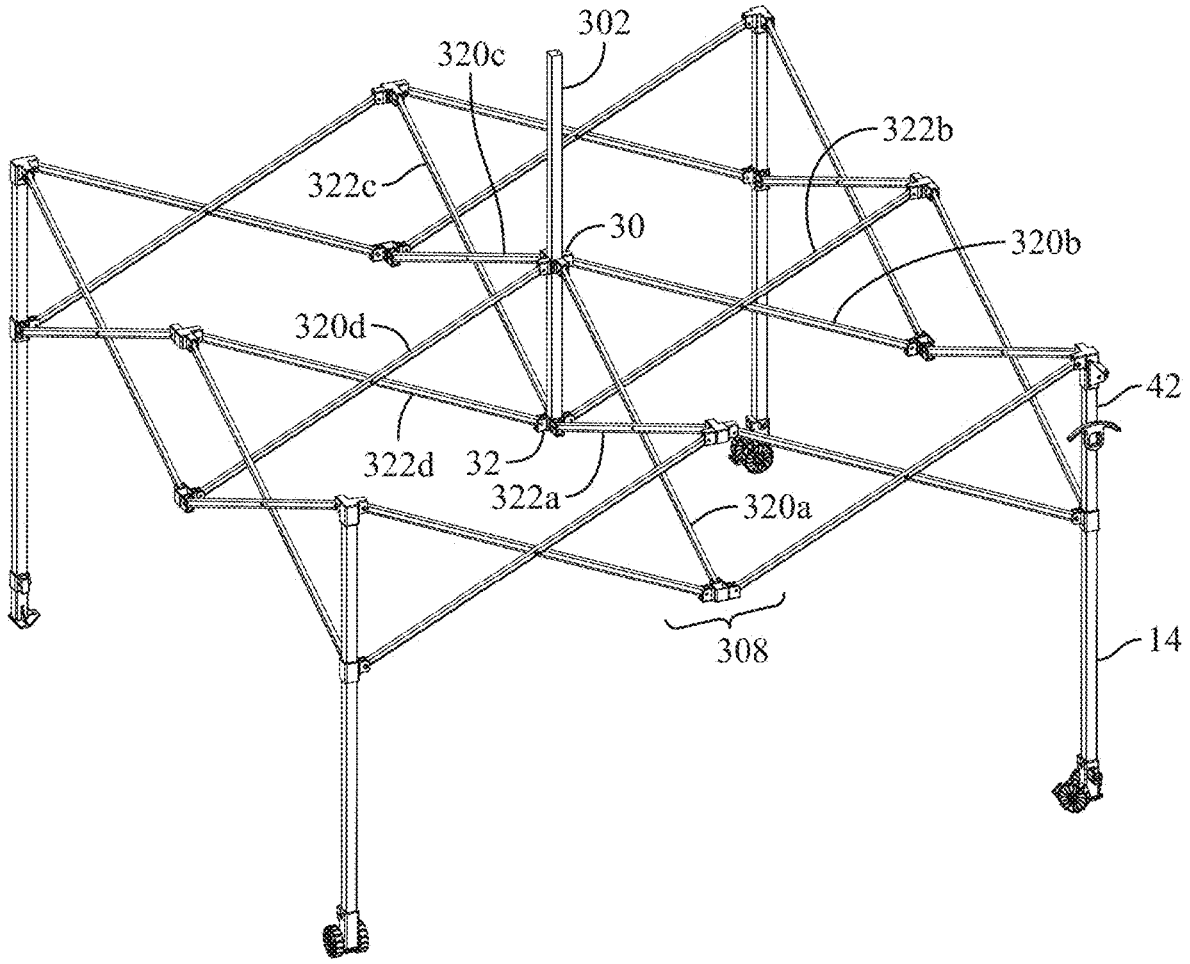
FIG. 11 illustrates an alternate routing of the cable.

Referring now to FIG. 11, the same illustrates a frame structure similar to the frame shown in FIG. 10, incorporating the central post 302, upper hub 30, and lower hub 32 except the support legs are not diagonally connected to the upper and lower hubs 30, 32. Instead, they 14 are connected to the upper and lower hubs via upper and lower side poles 320*a-d* and 322*a-d*. Also, the cable 42 is routed differently in this embodiment so that forces are transferred via a different route during deployment and retraction of the canopy 10.

In the configuration shown in FIG. 11, the cable 42 is routed from a support leg 14 to a middle portion 308 of one side of the frame. From there, the cable 42 is directed to one 320*a* of four side poles 320*a, b, c, d*, which are positioned along the perimeter of the frame. The cable 42 then continues its path to the upper hub 30 and subsequently to the lower hub 32, facilitating the sliding motion of the upper hub 30 along the central post 302, as discussed herein in relation to the embodiment shown in FIGS. 1-9F.

The cable 42 is still operatively connected to the pull handle 26, enabling a single user to tension the cable and draw the upper hub 30 downward along the central post 302 during deployment. When the canopy 10 is fully deployed, the upper hub 30 rests against the stopper, such as a pin or a spacer, mounted on the central post 300. This arrangement ensures the proper alignment and tension of the canopy cover 12, supported at its center by the top end 304 of the central post 300.

The frame structure in FIG. 11 retains the features described in FIGS. 1 through 10, allowing for the implementation of various aspects, including the telescoping legs 14, elongate members 66, sliding brackets 248, and stabilizing brackets 52. This alternative cable routing adds flexibility to the design, providing an improved mechanism for guiding the movement of the upper and lower hubs while maintaining the frame's structural integrity.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A folding canopy for providing shade when in a deployed position and foldable to a folded position for storage, the folding canopy comprising:

a plurality of telescoping support legs configured to support the canopy on a surface;

a central upper hub;

a central lower hub, wherein the central upper hub and the central lower hub are initially separated when the canopy is in the folded position;

a plurality of elongate members pivotably connected to one another, wherein:

a first elongate member is pivotably attached to the central upper hub;

a second elongate member is pivotably attached to the central lower hub; and the first elongate member and the second elongate member are pivotably attached to each other, such that when the central lower hub and the central upper hub are forced closer to each other, the elongate members push the support legs outward;

pairs of elongate members pivotably connected to one another via stabilizing brackets and connected to the support legs to stabilize the canopy in a deployed position;

a handle positioned adjacent to one of the support legs;

a cable operatively connected to the handle and routed to and through the central upper hub, the cable being attached to the central lower hub;

a series of pulleys configured to guide the cable to and through the central upper hub;

wherein pulling the handle causes the cable to exert a force on the central lower hub, drawing the central lower hub toward the central upper hub, thereby causing the elongate members to push the support legs outward and traverse the canopy from the folded position to the deployed position, without requiring a user to be under the canopy.

2. The folding canopy of claim 1, wherein the pairs of pivotable elongate members are attached to an upper corner bracket which is attached to an upper portion of an upper leg of the support leg and a sliding bracket which slides up and down the upper leg as the canopy is traversed between the folded position and the deployed position.

3. The folding canopy of claim 1, wherein the handle is removably securable to one of the support legs, such that:

when the canopy is in the folded position, the handle is positioned near an upper portion of an upper leg of the support leg; and when the canopy is in the deployed position, the handle is positioned near a lower portion of the upper leg of the support leg.

4. The folding canopy of claim 1, wherein each support leg is telescoping and comprises:

an upper leg having at least one hole;

a lower leg traversable into and out of the upper leg and having a plurality of holes spaced along its length;

a middle bracket configured to telescopically position the lower leg with respect to the upper leg, the middle bracket comprising a pin that is removably insertable into the hole of the upper leg and any one of the plurality of holes of the lower leg, thereby allowing adjustable extension or retraction of the support leg.

5. The folding canopy of claim 1, wherein the lower leg comprises a foot, the foot having a front portion and a rear portion that are curved upward, wherein the curved front and rear portions are configured to allow the foot to slide across the surface and traverse over uneven obstacles of the surface, thereby assisting the user in deploying and folding the canopy.

6. The folding canopy of claim 1, wherein:

the canopy comprises four support legs;

one of the support legs includes a stationary foot configured to remain fixed in position when the canopy is traversed from the folded position to the deployed position;

the support leg opposite the stationary foot includes a sliding foot, wherein the sliding foot is directional and aligned along a line extending from the stationary foot to the opposite support leg, such that during deployment, the opposite support leg is pulled straight back; and the other two support legs each include a sliding foot, wherein the sliding feet are oriented along lines extending from the stationary foot to the respective support legs to which each sliding foot is attached, thereby facilitating the sliding foot to traverse over uneven terrain of the surface during deployment and folding of the canopy.

7. The folding canopy of claim 1, wherein a pair of wheels is attached to a lower portion of the upper leg of at least one support leg, the wheels being configured to facilitate rolling movement of the canopy during deployment or retraction, allowing the user to deploy and fold the canopy.

8. The folding canopy of claim 1, wherein the stationary foot includes a high-friction surface on its underside, the high-friction surface being configured to resist sliding and provide stability during deployment or retraction of the canopy.

9. The folding canopy of claim 1, wherein the stationary foot includes a plurality of spikes extending from its bottom surface, the spikes being configured to penetrate the surface to prevent movement of the stationary foot during deployment or folding of the canopy.

10. The folding canopy of claim 1, wherein the lower surface of each sliding foot is positioned higher than the bottom contact patch of the wheels with the surface when the lower leg is fully retracted within the upper leg, thereby ensuring that the canopy can be rolled on the wheels without interference from the sliding foot.

11. The folding canopy of claim 1, wherein the handle is attached to a latch disposed at a lower portion of the upper leg of the support leg, the latch being configured to secure the handle in place and maintain the canopy in the deployed position when the canopy is in the deployed position.

12. The folding canopy of claim 1, wherein:

the elongate members pivot between their end portions and are pivotably connected to each other via a pivoting bracket;

the pivoting bracket includes a cavity configured to receive an end portion of one of the elongate members;

the pivoting bracket further includes a slot configured to receive another end portion of another elongate member, wherein the elongate member pivots into the slot to reinforce the pivoting connection during deployment of the canopy;

when the canopy is in the folded position, the two elongate members are at a first angle with respect to each other; and as the canopy traverses to the deployed position, the angle between the elongate members increases until the two elongate members achieve a second desired angle with respect to each other, the elongate member being received in the slot to thereby enhance structural integrity of the canopy when in the deployed position.

13. A method for deploying a folding canopy, the method comprising:

providing a plurality of telescoping support legs, a central upper hub, a central lower hub, a plurality of pivotably connected elongate members, a handle, a cable routed through the central upper hub and connected to the central lower hub, and a series of pulleys;

with the support legs fully retracted, pulling the handle to tension the cable while the user is outside an outer periphery of the canopy;

drawing the central lower hub closer to the central upper hub with the cable;

causing the pivotably connected elongate members to push the support legs outward; and traversing the canopy from a folded position to a deployed position without requiring the user to walk underneath the canopy positioning the handle near an upper portion of an upper leg of one of the support legs when the canopy is in the folded position;

pulling the handle to a lower portion of the upper leg of the support leg to traverse the canopy to the deployed position; and securing the handle to a latch on the lower portion of the upper leg of the support leg to maintain the canopy in the deployed position.

14. The method of claim 13, further comprising:

adjusting the length of a telescoping support leg by:

sliding a lower leg into or out of an upper leg;

aligning one of a plurality of holes in the lower leg with a hole in the upper leg; and inserting a pin of a middle bracket into the aligned holes to secure the lower leg to the upper leg for fixing a desired length of the support leg.

15. The method of claim 13, further comprising:

sliding a sliding foot on a support leg across the surface and over uneven terrain when traversing the canopy from the folded position to the deployed position;

maintaining the position of a stationary foot by utilizing a high-friction surface to resist movement when traversing the canopy from the folded position to the deployed position; and locking the canopy in the deployed position after the canopy has been traversed from the folded position to the deployed position.

16. The method of claim 13, further comprising:

pivoting elongate members relative to each other during deployment by:

providing an end portion of one elongate member in a cavity of a pivoting bracket;

increasing an angle between the elongate members as the canopy moves from the folded position to the deployed position; and sliding another end portion of another elongate member into a slot of the pivoting bracket to form a stabilized pivoting connection.

17. The method of claim 13, further comprising:

aligning the sliding feet of the support legs along lines extending from a stationary foot to the respective support legs to which the sliding feet are attached, thereby mitigating the sliding feet from snagging on uneven terrain when the canopy is traversed from the folded position to the deployed position.

18. The method of claim 13, further comprising:

rolling the canopy on wheels attached to a lower portion of an upper leg of at least one support leg with the lower leg fully retracted into the upper leg;

ensuring the lower surface of the sliding foot is positioned higher than the bottom contact patch of the wheels with the surface when the lower leg is fully retracted within the upper leg, thereby preventing interference during movement.

* * * * *